US006062667A

United States Patent [19]

Matsui et al.

[11] Patent Number: 6,062,667

[45] Date of Patent: May 16, 2000

[54] INK JET RECORDING APPARATUS CONSTRUCTED TO DETECT A PROPERLY MOUNTED INK CARTRIDGE

[75] Inventors: Shinya Matsui, Yokohama; Tetsuo Suzuki, Kawasaki; Hiroyuki Inoue, Chiba; Soichi Hiramatsu, Yokohama, all of Japan

[73] Assignee: Canon Kabushiki Kaisha, Tokyo, Japan

[21] Appl. No.: 08/590,819

[22] Filed: Jan. 24, 1996

Related U.S. Application Data

[62] Division of application No. 08/405,399, Mar. 15, 1995, Pat. No. 5,506,611, which is a continuation of application No. 08/098,254, Jul. 29, 1993, abandoned, which is a division of application No. 07/563,080, Aug. 6, 1990, abandoned.

[30] Foreign Application Priority Data

| | | | |
|---|---|---|---|
| Aug. 5, 1989 | [JP] | Japan | 1-203535 |
| Dec. 25, 1989 | [JP] | Japan | 1-336142 |
| Dec. 25, 1989 | [JP] | Japan | 1-336143 |
| Dec. 26, 1989 | [JP] | Japan | 1-334824 |
| Jan. 19, 1990 | [JP] | Japan | 2-008302 |

[51] Int. Cl.[7] ..... B41J 2/175

[52] U.S. Cl. ..... 347/19

[58] Field of Search ..... 347/19, 86, 87, 347/49, 7, 37

[56] References Cited

U.S. PATENT DOCUMENTS

| | | | |
|---|---|---|---|
| 4,177,471 | 12/1979 | Mitchell | 347/37 |
| 4,313,124 | 1/1982 | Hara . | |
| 4,345,262 | 8/1982 | Shirato et al. . | |
| 4,350,448 | 9/1982 | Hanagata et al. . | |
| 4,361,844 | 11/1982 | Nozaki et al. . | |
| 4,380,019 | 4/1983 | Steinberger | 347/7 |
| 4,447,820 | 5/1984 | Terasawa | 346/140 R |
| 4,459,600 | 7/1984 | Sato et al. . | |
| 4,463,359 | 7/1984 | Ayata et al. . | |
| 4,500,195 | 2/1985 | Hosono . | |

(List continued on next page.)

FOREIGN PATENT DOCUMENTS

| | | | |
|---|---|---|---|
| 3048426 | 7/1982 | Germany | B65D 79/02 |
| 3220939 | 1/1983 | Germany | B41J 27/00 |
| 3339138 | 5/1985 | Germany | B41J 27/00 |
| 3405164 | 8/1985 | Germany | B41J 27/00 |
| 3529805 | 2/1987 | Germany . | |
| 8816274 U | 3/1989 | Germany . | |
| 88 16 274 | 4/1989 | Germany . | |

(List continued on next page.)

OTHER PUBLICATIONS

Lonis, Robert A.; Storage of Operating Parameters in Memory Integral with Printhead; Xerox Disc. Journal, V8, N6, Nov./Dec. 1983; p. 503.

*Primary Examiner*—Joseph Hartary

*Attorney, Agent, or Firm*—Fitzpatrick, Cella, Harper & Scinto

[57] ABSTRACT

An ink cartridge, removably mountable on a fixed mounting portion of an ink jet recording apparatus for supplying discharged ink to a recording head carried on a movable carriage of the apparatus, comprises a flag member mounted for protrusion and retraction, an arrangement for protruding the flag member toward a path along which the carriage is moved when the ink cartridge is mounted on the mounting portion, and a photosensor mounted on the carriage in a position where it will be shielded from light by the protruding flag member.

3 Claims, 26 Drawing Sheets

U.S. PATENT DOCUMENTS

| | | | |
|---|---|---|---|
| 4,544,931 | 10/1985 | Watanabe | 347/37 X |
| 4,551,734 | 11/1985 | Causley et al. . | |
| 4,558,333 | 12/1985 | Sugitani et al. . | |
| 4,604,633 | 8/1986 | Kimura | 347/7 |
| 4,628,332 | 12/1986 | Matsumoto . | |
| 4,635,080 | 1/1987 | Watanabe | 347/50 |
| 4,695,824 | 9/1987 | Tazaki | 347/86 |
| 4,698,650 | 10/1987 | Watanabe | 347/86 X |
| 4,712,172 | 12/1987 | Kiyohara et al. | 347/60 |
| 4,723,129 | 2/1988 | Endo et al. | 347/56 |
| 4,740,796 | 4/1988 | Endo et al. | 347/56 |
| 4,741,634 | 5/1988 | Nozaki et al. . | |
| 4,760,409 | 7/1988 | Kiyohara et al. | 347/86 |
| 4,788,861 | 12/1988 | Lichti | 73/304 R |
| 4,872,027 | 10/1989 | Buskirk | 347/19 |
| 4,912,512 | 3/1990 | Midorikawa | 355/260 |
| 4,939,528 | 7/1990 | Yamamoto et al. . | |
| 4,965,596 | 10/1990 | Nagoshi et al. | 347/36 |
| 4,977,413 | 12/1990 | Yamanaka | 347/7 |
| 5,049,898 | 9/1991 | Arthur | 347/19 |
| 5,075,724 | 12/1991 | Wada | 355/260 X |
| 5,162,817 | 11/1992 | Tajika et al. | 347/7 |
| 5,168,291 | 12/1992 | Hiramatsu | 347/86 X |
| 5,235,351 | 8/1993 | Koizumi | 347/19 |
| 5,506,611 | 4/1996 | Ujita et al. | 347/86 |
| 5,627,570 | 5/1997 | Hiramatsu | 347/37 X |

FOREIGN PATENT DOCUMENTS

| | | | |
|---|---|---|---|
| 54-51837 | 4/1979 | Japan . | |
| 54-56847 | 5/1979 | Japan . | |
| 59-123670 | 7/1984 | Japan . | |
| 59-138461 | 8/1984 | Japan . | |
| 59-214656 | 12/1984 | Japan . | |
| 360042052 | 3/1985 | Japan | B41J 3/04 |
| 60-71260 | 4/1985 | Japan . | |
| 362095224 | 5/1987 | Japan | B41J 3/04 |
| 62-184856 | 8/1987 | Japan . | |
| 62-255151 | 11/1987 | Japan . | |
| 63-15752 | 1/1988 | Japan | B41J 3/04 |
| 63-147649 | 6/1988 | Japan . | |
| 64-075249 | 3/1989 | Japan | B41J 3/04 |
| 1-141750 | 6/1989 | Japan . | |
| 1141750 | 6/1989 | Japan . | |
| WO 86/06032 | 10/1986 | WIPO . | |
| WO86/6032 | 10/1986 | WIPO . | |

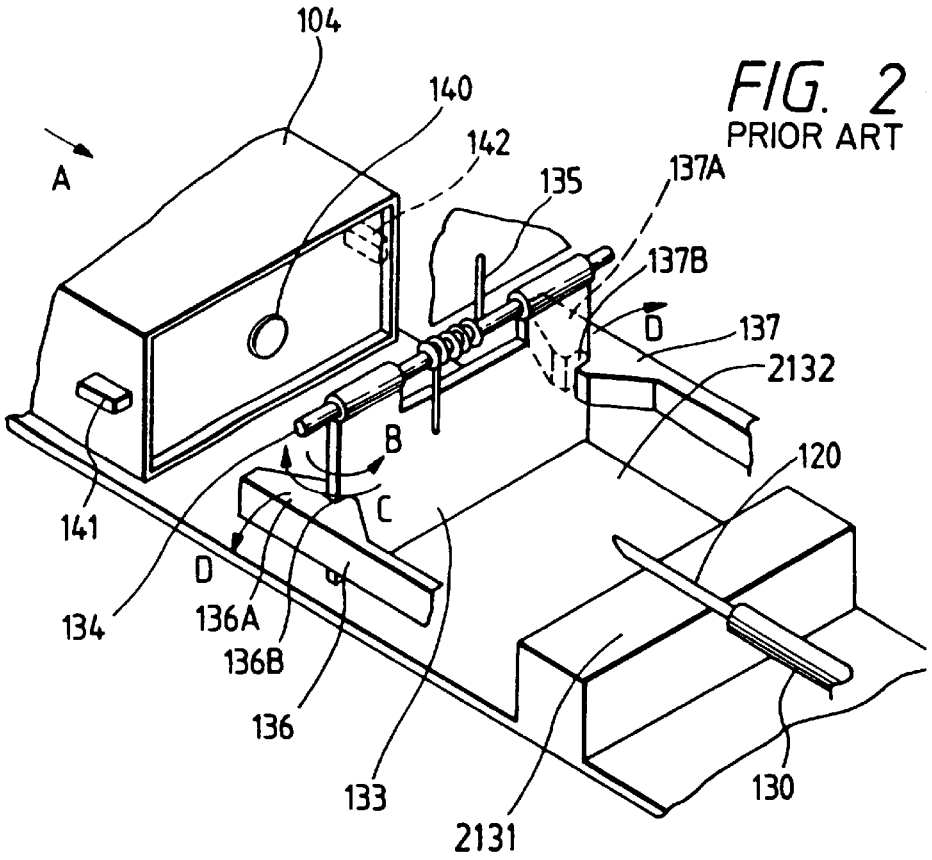
FIG. 2
PRIOR ART
FIG. 4
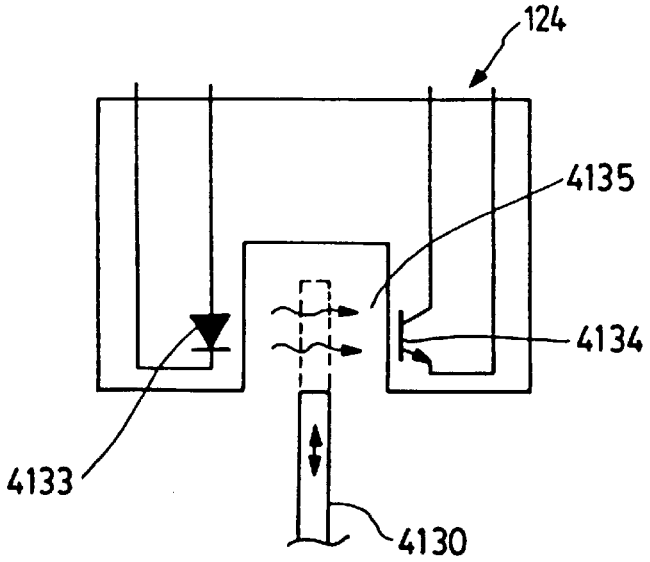

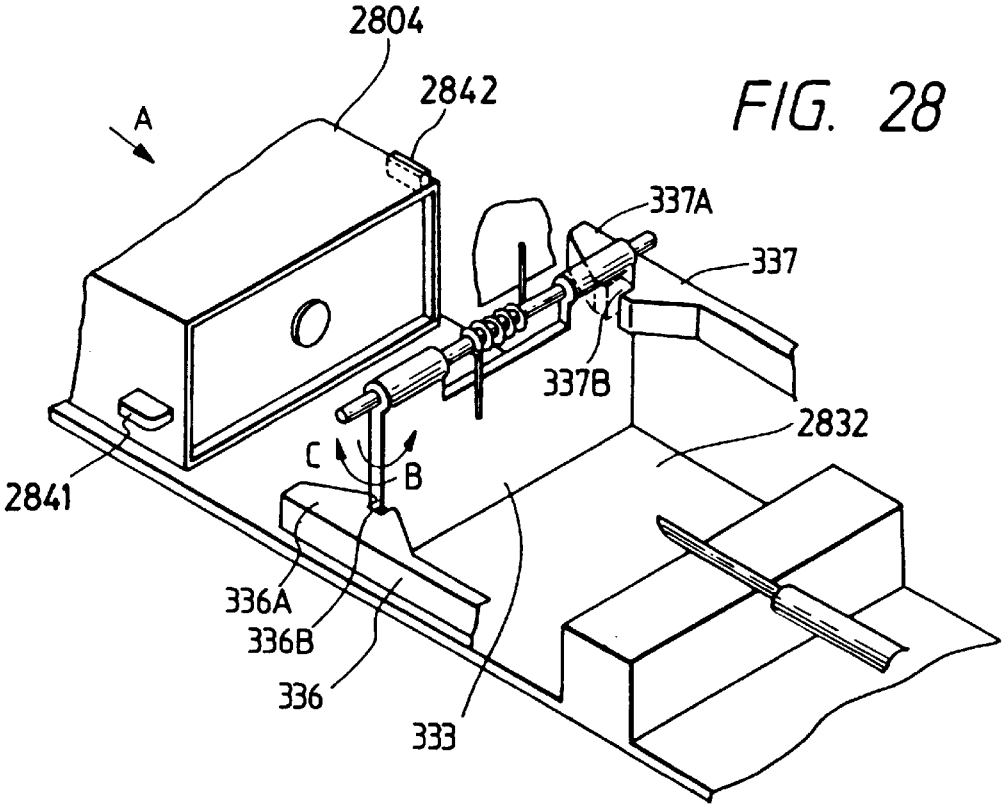
FIG. 28
FIG. 29A
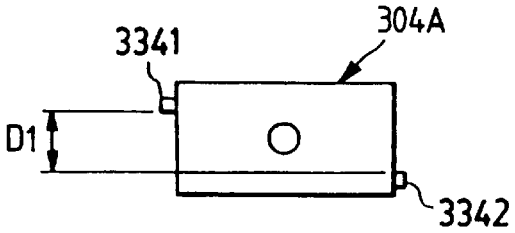
FIG. 29B
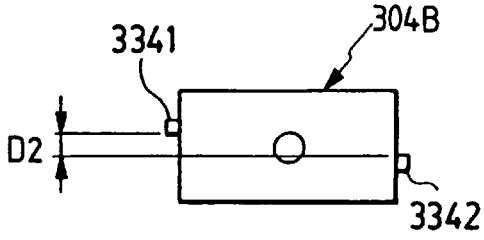

INK JET RECORDING APPARATUS CONSTRUCTED TO DETECT A PROPERLY MOUNTED INK CARTRIDGE

This application is a division of application Ser. No. 08/405,399, filed Mar. 15, 1995 now U.S. Pat. No. 5,506,611, which is a continuation of application Ser. No. 08/098,254 filed Jul. 29, 1993, now abandoned, which is a division of application Ser. No. 07/563,080 filed Aug. 6, 1990, now abandoned.

BACKGROUND OF THE INVENTION

1. Field of the Invention

This invention relates to an ink jet recording apparatus provided with an ink jet head for effecting recording with flying ink droplets utilizing the film boiling phenomenon of liquid ink.

2. Related Background Art

In recent years, various ink jet recording methods have been put into practical use because in such recording methods, the creation of noise during recording is negligibly small and in addition, recording can be effected on plain paper.

Among such methods, the ink jet recording method described, for example, in Japanese Laid-Open Patent Application No. 54-59336 (the so-called bubble jet recording method) is such that heat energy is caused to act on ink and the ink subjected to the action of this heat energy undergoes a sudden volume change (film boiling phenomenon) resulting from a state change; by this action force, the ink is discharged from a discharge port at the end of a recording head unit, whereby flying ink droplets are formed and adhere to a recording medium to thereby accomplish recording.

The principle of ink droplet formation in such a recording method is that when an electro-thermal converting member is electrically energized, the ink in the heat-acting portion subjected to the action of the heat energy which is ink droplet forming energy undergoes a state change resulting from a sudden increase in volume; that is, the ink in the heat-acting portion causes the creation, growth and contraction of a bubble very momentarily, whereby liquid present between the heat-acting portion and the discharge opening is discharged as an ink droplet.

By repeating such a cycle of creation, growth, contracting and disappearance of the bubble, the ink is subjected to high heat. Therefore, thermally unstable ink is liable to undergo a chemical change and in the heat-acting portion, production and precipitation of insoluble matter may occur and eventually the recording head may become incapable of discharging the ink. Accordingly, to effect recording at a high speed for a long time by the use of such an apparatus, it is very important to improve the stability of the ink and on the other hand, to set the optimum driving conditions corresponding to the ink in the recording head.

FIG. 1 of the accompanying drawings shows variations with time in the surface temperature T of the heat-acting surface when an electrical signal of pulse waveform shown by P is input to a recording head having an electro-thermal converting member and the volume V of a bubble then created. When the pulse-like electrical signal P which is switched on and off is input to the electro-thermal converting member between a time $t_o$ and a time $t_p$, the surface temperature T of the heat-acting surface reaches a maximum temperature $T_P$ at the time $t_f$.

Here, when $T_P$ is higher than the boiling point of the ink which is in contact with the heat-acting surface, a bubble begins to be created from a time $t_{B0}$ at which $T=T_B$ in the heat-acting portion filled with the ink, and the volume thereof increases with the lapse of time and reaches a maximum volume $V_P$ at a time $t_p$. When the electrical signal P is switched off at the time $t_p$, the surface temperature T begins to attenuate gradually and accordingly, the volume V of the bubble decreases and the bubble disappears at a time $t_{B1}$.

In order to ensure that the discharge of ink droplets is effected efficiently and stably in an ink jet recording apparatus, for example, in the bubble jet recording method described above, driving conditions for film boiling such as a voltage, a pulse width and a frequency at which electrical energy is supplied to the electro-thermal converting member, and further, control such as a pre-discharging or pre-heating for effecting stable practical printing, or the recovery operation of the recording head, are programmed in advance in the ink jet recording apparatus. Particularly, in a recording apparatus of the type in which an ink tank storing therein ink to be supplied to a recording head is interchangeable for the apparatus, if use is made of an ink cartridge storing therein ink of another kind which does not match these various set conditions, there will not be obtained an appropriate combination of the characteristics of the ink and the driving conditions and therefore, normal driving of the recording head cannot be accomplished and recording of high quality will become difficult. For this reason, usually, the form of the ink cartridge interchangeable for the recording apparatus is designed exclusively for each apparatus so that the user may not misuse the ink cartridge.

An example of the form of such an ink cartridge is a box-like form. The ink cartridge is designed so that by the operation of mounting the ink cartridge on a cartridge mounting portion, a hollow needle provided on the mounting portion is thrust in the rubber plug of the cartridge so that the ink may be supplied from an ink containing portion in the cartridge to an ink supply system through the hollow needle.

However, the conventional ink jet recording apparatus having such an interchangeable ink cartridge only permits the use of ink fit for the discharge conditions set in that apparatus, and cannot select ink of different discharge conditions; the range of use of the ink jet recording apparatus is therefore limited and a wide range of use of ink jet recording apparatus having an excellent recording characteristic has been difficult. Also, even if ink having more excellent discharge and recording characteristics is developed in the future, it will become impossible to use such ink or obtain satisfactory printing with the apparatus, because the program in the apparatus is not proper.

The above-noted problems will hereinafter be discussed specifically and in detail. Some examples of typical ink compositions usable in an ink jet recording apparatus are shown in Table 1 below.

TABLE 1

| Kinds of ink/Component | | #1 | #2 | #3 |
|---|---|---|---|---|
| Water | [%] | 50 | 50 | 80 |
| DEG | [%] | 47 | 37 | 17 |
| PEG | [%] | 0 | 10 | 0 |
| Dyestuff | [%] | 3 | 3 | 3 |

Ink #1 is an example of standard ink which exhibits a popular performance in both viscosity and solidification. On the other hand, ink #2 is ink in which the percentage of the component difficult to volatilize is increased relative to the ink #1; relative to ink #2, ink #1 is characterized by a difficulty in clogging the discharge ports of the recording head. Thus, an ink jet recording apparatus using the ink #2 does not require a mechanism for preventing the clogging of the discharge ports during the downtime of the ink jet recording head, so that it can be structurally simplified. However, since the ink #2 has relatively high viscosity, it is necessary that discharge of the ink which does not contribute the recording, i.e., an operation called preliminary discharge, be sufficiently performed in advance in the early stage of each use. This may sometimes lead to a reduced throughput. Also, the ink #2 suffers from a disadvantage in that the ink readily blurs on the recording medium so that a very high quality of printing cannot be provided. Ink #3 is ink characterized in that the percentage of water content is increased relative to the ink #1 and the desiccation of the ink on the recording medium is quick, so that recording of high quality suffering much less from blurring can be accomplished. Further, the ink #3 has a feature in that it can be driven at a relatively high frequency because it permits quick refilling of the nozzle after discharge. However, the ink #3 is readily desiccated and therefore, the ink in the discharge ports of the recording is readily solidified during the downtime of the recording head. Therefore, it is necessary that the recovery operation, such as pumping and capping operations, be performed frequently during the downtime of the recording head. Particularly, where the ink #3 is used for a recording head of the bubble jet type in which heat energy is utilized as ink discharging energy, stable ink discharge cannot be accomplished unless the electrical energization time is made relatively short (e.g. 2–5 μsec) and the driving voltage is made correspondingly high. Accordingly, in the case of a recording head which can withstand such high driving stress, printing of high quality can be accomplished, but otherwise there will be obtained printing of low quality because it suffers from a lack of accuracy in the location where the liquid droplet lands on the recording medium.

Table 2 below specifically shows some examples of the driving conditions for the recording head relative to the inks in Table 1.

TABLE 2

| Examples of apparatus | Kinds of ink/ Driving conditions | #1 | #2 | #3 |
|---|---|---|---|---|
| I | Voltage [V] | 21 | 21 | 28 |
| | Pulse width [μs] | 7 | 7 | 3 |
| | Frequency [Khz] | 4.5 | 4.0 | 6.0 |
| | Number of preliminary discharges (times) | 50 | 128 | 50 |
| II | Voltage [V] | 21 | 19 | 21 |
| | Pulse width [μs] | 7 | 8.5 | 7 |
| | Frequency [Khz] | 2 | 2 | 3 |
| | Number of preliminary discharges (times) | 50 | 128 | 50 |

The apparatus example I is an apparatus using a single crystal of silicon as the base material of the recording head and carrying thereon a recording head capable of withstanding short pulse energization and high voltage driving and responding to a high frequency. The apparatus example II is an apparatus using glass as the base material of the recording head and carrying thereon a recording head which is low in durability with respect to short pulse energization, high voltage driving and high frequency, but is very inexpensive.

For example, when the apparatus example I programmed with the use of the ink #1 having the standard characteristics being taken into account is used in a manner in which the frequency of use is extremely low, it is desirable to use the ink #2 which does not cause clogging. However, it is necessary that the user change without fail the substance of the driving program of the recording head in which are set the conditions for the best discharge to be accomplished when the ink #1 is used to the substances matching the characteristics of the ink #2; for example, the conditions such as the number of preliminary discharges, the preheating state, the driving frequency and the pulse width.

To increase the printing speed in apparatus example I, the ink #3 can be used, but even in that case, as described previously, it is necessary that the user change without fail the driving conditions of the recording head in accordance with the characteristic of the ink #3.

However, it is cumbersome and prone to error for the user to change the driving conditions in accordance with the characteristics of the ink used, and damage is liable to occur to the recording apparatus due to the malfunctioning of the recording head. For example, where use is made of a recording head of the type of the apparatus example II, when the conditions for the use of the ink #1 are to be changed to the driving conditions for the use of the ink #3, the head driving voltage is changed from 21 V to 28 V and the pulse width is changed from 7 μsec to 3 μsec, whereby there is provided good discharge of the ink #3. However, as previously described, such driving conditions are not suitable because they give high stress to the recording head used in the apparatus example II and may therefore drastically shorten the life of the recording head. Accordingly, when the life of the recording head is taken into consideration, for example, the driving voltage must be changed to 21 V and the pulse width must be changed to the order of 7 μsec and moreover, the frequency must be changed from 6 Khz to 3 Khz.

As described above, it is adequate to use ink which takes into account the conditions and the purpose of use of the ink jet recording apparatus, but it is difficult for an ordinary user to minutely change the program in the ink jet recording apparatus body such as the driving conditions and the preliminary discharge conditions of the recording head, with the kind and driving characteristics of the recording head taken into account to cope with a change in the ink. Even if such a change is possible at all, a wrong setting may be effected so that abnormal printing occurs or excessive stress is given to the recording head; it thus will be difficult to ensure the reliability of the recording apparatus.

Now, when an ink cartridge interchangeable for the apparatus is mounted in the apparatus body, the ink cartridge generally is held by a suitable fastening means. Also, when the ink cartridge is mounted, the interior of the ink tank and the ink supply system on the apparatus body are communicated with each other.

However, if the relation between the holding position of the fastening means and the position in which the communication is effected is not appropriate, or especially if there is a play in the fastening means, the ink communication will not be secured in spite of the ink tank being held by the fastening means, and the ink supply system and the ink tank will become spaced from each other. If at this time, for example, the recovery operation is performed, air may be introduced into the ink supply system. If air is thus introduced into the ink supply system, not only will ink discharge fail to be properly effected, but also the recording head will be damaged.

On the other hand, when the ink cartridge is to be interchanged, the user may inadvertently insert his hand into the cartridge insertion port and have his fingertip injured or stained with ink. In order to prevent this, there has been provided a protective device as shown, for example, in FIG. 2 of the accompanying drawings. In FIG. 2, the reference numeral 130 designates an ink tube connected to a hollow needle 120 and supplying ink to the recording head, the reference numeral 2131 denotes a mounting bed for fixedly supporting the hollow needle 120, and the reference numeral 2132 designates an insertion path for directing the ink cartridge 104 to its mounted position.

The reference numeral 133 denotes a protective plate pivotable about a support shaft 134, the reference numeral 135 designates a torsion coil spring mounted around the support shaft 134 and biasing the protective plate 133 in the direction of arrow C, and the reference numerals 136 and 137 denote locking members for holding the protective plate 133 in an insertion path closing position as shown and restraining the movement thereof. That is, these locking members 136 and 137 are formed symmetrically with respect to each other, and respectively have wedge portions 136A and 137A and locking grooves 136B and 137B at opposed locations, and are both endowed with resiliency, whereby they can be flexed in the direction of arrow D. The reference numeral 140 designates a rubber plug provided in the front face of the ink cartridge 104, and the reference numerals 141 and 142 denote unlocking projecting members (hereinafter referred to as the unlocking members) provided on the sides of the ink cartridge 104.

In the protective device for the ink cartridge mounting portion which is so constructed, as long as the ink cartridge 104 is not mounted, the protective plate 133 is held in its shown position by the locking members 136 and 137, and even if a finger tip or the like is inserted into a cartridge guide or the like, it will strike against the protective plate 133 and will not reach the tip end of the hollow needle 120. Also, if as shown in FIG. 2, the ink cartridge 104 is inserted in the direction of arrow A along the insertion path 132, the unlocking members 141 and 142 will slidably contact with the wedge portions 136A and 137A of the locking members 136 and 137, respectively, and will push open these members in the direction of arrow D.

Consequently, the opposite end portions of the protective plate 133 are liberated from the locking grooves 136B and 137B of members 136 and 137 also, the front face of the ink cartridge 104 bears against the protective plate 133 and pushes it up in the direction of arrow B. Thereafter, the hollow needle 120 thrusts into the rubber plug 140 of the ink cartridge 104, whereby there can be brought about a mounted state in which the supply of ink to the recording head is possible. When the ink cartridge 104 is to be removed, the ink cartridge 104 is pulled out rearwardly from its mounted state, whereby the hollow needle 120 is pulled out from the rubber plug 140, and then the protective plate 133 is pivoted in the direction of arrow C by the spring force of the torsion coil spring 135 so that it returns to its vertical position and is sandwiched between the locking members 136 and 137 and restored to the state shown in FIG. 2.

However, in the conventional ink jet recording apparatus as described above, the locking members 136 and 137 are provided laterally symmetrically. Therefore, even when the user inserts the ink cartridge 104 with its vertical direction or its longitudinal direction mistaken, the locked state of the protective plate 133 will be released by the engagement between the unlocking members 141, 142 and the locking members 136, 137 and the ink cartridge 104 will then be directed to its mounted position. This has led to the undesirable possibility that the hollow needle 120 is damaged or the ink cartridge 104 itself is damaged and the supply of ink becomes impossible. Also, an attempt to provide a special device discretely to prevent such an accident would make the mounting device itself complicated in structure and result in increased cost.

Now, some ink cartridges are in a form which is provided with an ink containing portion and in addition, a waste ink containing portion for containing discharge ink, i.e., ink sucked during the recovery operation performed to prevent the clogging of the ink discharge ports of the recording head (hereinafter referred to as the waste ink). With such ink cartridges, it is possible to discard the waste ink contained in the waste ink containing portion, by and simultaneously with the interchange of the cartridge.

If, in an ink jet recording apparatus using such an interchangeable ink cartridge, the recording operation is performed with no ink cartridge mounted in the apparatus, recording will not be obtained because ink supply does not take place. Also, if the recovery operation is performed, waste ink discharged from the waste ink system side of the apparatus will not be contained in the ink cartridge but instead may be released into the apparatus to thereby contaminate the environment, or the released waste ink may contaminate electric circuits to thereby cause accidents, such as a fire. Accordingly, it is desirable to provide detecting means for informing the user of the mounting of an ink cartridge in the apparatus.

An example of such a detecting means is shown in FIGS. 3 and 4 of the accompanying drawings. As shown in FIG. 3, a cartridge detecting flag 131 is comprised of a rotatable flag shaft 131B supported on the upper portion of an insertion port 121, a flag plate 131C mounted on one end of the shaft, and a cam portion 131A for rotating the flag shaft 131B. A lever member 132 pivotally moved by the mounting of a cartridge 104 is provided inside the insertion port 121. Thus, when the ink cartridge 104 is inserted into the insertion port 121 and is securely mounted with a hollow needle 120 being inserted into a tank, not shown, in the cartridge 104, the projected portion 132A of the lever member 132 is pressed by the forward end of the cartridge 104, whereby the tip end portion 132B of the lever pivotally moves the flag plate 131C through the cam portion 131A and keeps it in a light intercepting position for a detecting sensor 124 as shown.

FIG. 4 shows the details of the detecting sensor 124 for detecting both of the home position and the cartridge. The detecting sensor 124 is of the transmission type and is provided with an optical path 4135 between a light emitting element 4133 and a light receiving element 4134, and is designed such that the optical path 4135 is shielded from light by a home position detecting flag 4130 such as, for example, the flag plate 131C of the ink cartridge detecting flag 131, etc. Accordingly, when the ink cartridge 104 is mounted, the detecting sensor 124 detects the flag plate 131C when a carriage 102 has been directed to a detecting position, whereby the mounting of the cartridge is confirmed.

However, in the conventional ink jet recording apparatus as described above, the home position sensor is used also as the cartridge detecting sensor and the number of detecting means is correspondingly decreased, but the information the user wants to recognize about the ink cartridge 104 is not only the mounting thereof, but also information regarding the color and characteristics of the ink contained in the ink cartridge 104 as described previously as well as the remaining amount of ink. To enable all of such information to be obtained, the number of flags must be increased or the number of detecting means themselves must be increased; this will result in more complicated structure, which in turn will result in an increased cost.

SUMMARY OF THE INVENTION

It is an object of the present invention to eliminate such problems peculiar to the prior art and to provide an ink cartridge to which is imparted information for controlling the driving conditions of a recording head on the basis of the ink used.

It is also an object of the present invention to provide an ink jet recording apparatus of high performance and high reliability in which an ink jet recording head changes its driving conditions in accordance with the ink used.

It is a further object of the present invention to provide an ink jet recording apparatus and an ink cartridge with a construction of such correlation that the mounting of the ink cartridge into the apparatus can be reliably accomplished, and to ensure that ink supply, information reading, etc. are reliably effected.

It is another object of the present invention to provide an ink cartridge which is simple in structure and can prevent malfunctioning during the mounting of the cartridge, and an ink jet recording apparatus into which such an ink cartridge can be mounted.

It is still another object of the present invention to provide an ink jet recording apparatus in which a minimum number of detecting means enables the user to recognize various kinds of information regarding an ink cartridge, and to provide such an ink cartridge.

It is still another object of the present invention to provide an ink cartridge which is interchangeably provided for an ink jet recording apparatus provided with a recording head for causing the discharge of ink to thereby effect the recording of images and which contains said ink therein and supplies said ink in response to the discharge of said ink, characterized by the provision of a medium provided with information for controlling the driving conditions of said recording head.

It is also an object of the present invention to provide an ink jet recording apparatus which permits the removable mounting therein of an ink tank cartridge forming a supply source of ink for a recording head for discharging said ink to a recording medium to thereby effect recording, characterized by the provision of:

communication means for effecting communication between said ink tank and the supplied ink;

reading means for reading the information regarding said ink tank cartridge itself from an information presenting member provided on said ink tank cartridge to present said information; and holding means for holding said ink tank cartridge; and also characterized by three positions being defined, namely a position in which said ink communication is effected, a position in which said information is read and a position in which said ink tank cartridge is held, being disposed in the named order in the direction of mounting of said ink tank cartridge.

It is a further object of the present invention to provide an ink tank cartridge forming a supply source of ink for a recording head for discharging said ink to a recording medium to thereby effect recording, characterized by the provision of:

an information presenting member provided to present the information regarding the ink tank cartridge itself;

a communication member for effecting the communication of the supplied ink with an apparatus body; and a holding member with which the ink tank cartridge is held by said apparatus body;

said communication member, said information presenting member and said holding member being disposed so that the communication of said supplied ink, the reading of said information and said holding may be effected in the named order with the mounting operation of said ink tank cartridge.

It is still further object of the present invention to provide an ink jet recording apparatus characterized by the provision of:

an ink tank cartridge which forms a supply source of ink for a recording head for discharging said ink toward a recording medium to thereby effect recording and which is provided with a member for presenting inherent information regarding said ink tank cartridge itself and second information differing from said inherent information, and is removably mountable in an apparatus body;

communication means for effecting communication between said ink tank cartridge and the supplied ink;

reading means for reading said inherent information and said second information; and holding means for holding said ink tank cartridge; and also characterized by four positions being defined, namely a position in which said ink communication is effected, a position in which said second information is read, a position in which said inherent information is read and a position in which said ink tank cartridge is held, being disposed in the named order in the direction of mounting of said ink tank cartridge.

It is another object of the present invention to provide an ink tank cartridge for an ink jet recording apparatus which forms an ink supply source for a recording head for discharging ink and which is removably mountable in the apparatus body, characterized by the provision of an inherent information presenting member for presenting inherent information regarding the ink tank cartridge itself, and a second information presenting member, provided forward of said inherent information presenting member with respect to the direction of mounting, for presenting second information differing from said inherent information.

It is still another object of the present invention to provide an ink cartridge which is mountable on a mounting portion along the insertion path of an ink jet recording apparatus, where the apparatus has an openable-closable plate openably and closably held in the insertion path leading to said mounting portion, and locking members for restraining said openable-closeable plate from the opposite sides of said insertion path to inhibit the opening movement thereof; and where the ink cartridge contains therein ink to be supplied to a recording head and in which unlocking members engageable with said locking members to thereby release the restraint of said locking member during the mounting of said ink cartridge are projectedly provided on opposite sides, characterized in that said unlocking members are provided asymmetrically with respect to the direction of insertion into said insertion path.

It is yet another object of the present invention to provide an ink jet recording apparatus which is provided with an openable-closeable plate provided in an insertion path for directing to a mounting portion an ink cartridge containing therein ink to be supplied to a recording head, the plate being openably and closably held, and also provided with locking members for restraining said openable-closable plate from the opposite sides of said insertion path to inhibit the opening movement thereof and in which the restraint of said locking members can be released by unlocking members projectedly provided on the opposite sides of said ink cartridge during the insertion of said ink cartridge into said insertion path, characterized in that said unlocking members and said locking members are disposed asymmetrically with respect to the direction of insertion of said ink cartridge.

It is another object of the present invention to provide an ink jet recording apparatus in which is removably mounted an ink cartridge containing therein ink to be supplied to a recording head for discharging the ink to thereby effect recording, characterized by the provision of:

a flag member provided on said ink cartridge and which protrudes toward a path along which a carriage is moved only when said ink cartridge is mounted on a mounting portion; and a photosensor provided on said cartridge and capable of being shielded from light by said flag member.

It is still another object of the present invention to provide an ink cartridge which is removably mounted on the fixed mounting portion of an ink jet recording apparatus for supplying discharged ink to a recording head carried on a movable carriage, characterized by the provision of a flag member capable of being protruded and contained, and means for protruding said flag member toward a path along which said carriage is moved only when said ink cartridge is mounted on said mounting portion, and in which the flag member intercepts light directed at a photosensor provided on said carriage.

By providing on an ink cartridge a medium including information for driving an ink jet head, the driving conditions of the ink jet head matching the composition of the ink can be automatically set by an ink jet recording apparatus itself, and this leads to the possibility of providing an ink jet recording head which is simple to operate and high in reliability.

Also, there can be provided an ink cartridge which can be prevented from being erroneously inserted by the user and which has information for properly controlling the driving of a recording head.

Further, in a position wherein an ink cartridge is held in an apparatus body, the communication between an ink supply system and ink is effected prior thereto and therefore, the ink communication state can be secured near the held position of the ink cartridge. In addition, prior to the holding, the information regarding the ink cartridge is readable and therefore, illegibility or misjudgment of the information does not occur near the held position. Furthermore, the ink communication is effected prior to reading and therefore, even if the recording operation is immediately started in response to reading, there will occur no inconvenience such as the introduction of air into the ink supply system. Conversely, even if the ink cartridge is pulled out during the recording operation, this can be detected before the ink communication is cut off and therefore, there will occur no similar inconvenience if the recording operation is discontinued.

Also, according to the present invention, in the position wherein the ink cartridge is held in the apparatus body, the communication between the ink supply system and ink is effected prior thereto and therefore, the ink communication state can be secured near the held position of the ink cartridge. Further, the inherent information regarding the ink cartridge becomes readable near the held position, and information differing from said information is read in a predetermined range from the ink communication position to the vicinity of the held position. Therefore, if the design is made such that a warning is given in response to the reading of this information, the unsatisfactory holding of the ink cartridge can be detected, so that the ink cartridge can be prevented from falling off the apparatus.

Furthermore, the horizontal positions of the unlocking members provided on the side of the ink cartridge and the horizontal positions of the locking members provided correspondingly to them are made asymmetrical with respect to the direction of insertion, i.e., different from each other with respect to the vertical direction or the direction of insertion. Therefore, if the ink cartridge is inserted into the mounting portion with the vertical direction or the longitudinal direction thereof being mistaken, the locking members and the unlocking members will not come into engagement with each other and the locked state will not be released; the ink cartridge thus will be prevented from being mounted by mistake and accordingly, any damage attributable to incorrect mounting can be prevented.

Also, according to the present invention, the flag member capable of being protruded and contained which is provided on the ink cartridge is protruded from the cartridge toward the path along which the carriage is moved when the ink cartridge is mounted on the mounting portion. Therefore, the mounting of the ink cartridge can be detected by the photosensor carried on the carriage, and by variously changing the form of the flag member and characterizing each ink cartridge, the information for a plurality of ink cartridges can be individually judged by a combination thereof with the moved position of the carriage.

BRIEF DESCRIPTION OF THE DRAWINGS

FIG. 2 is a perspective view showing the construction of an ink cartridge mounting mechanism according to the prior art.

FIG. 4 illustrates a photosensor for the detecting device of FIG. 3.

FIG. 28 is a perspective view showing the construction according to another embodiment of the present invention.

FIGS. 29A and 29B illustrate still another embodiment of the present invention.

DESCRIPTION OF THE PREFERRED EMBODIMENTS

Some embodiments of the present invention will hereinafter be described in detail with reference to the drawings.

Embodiment 1

Figure 1:
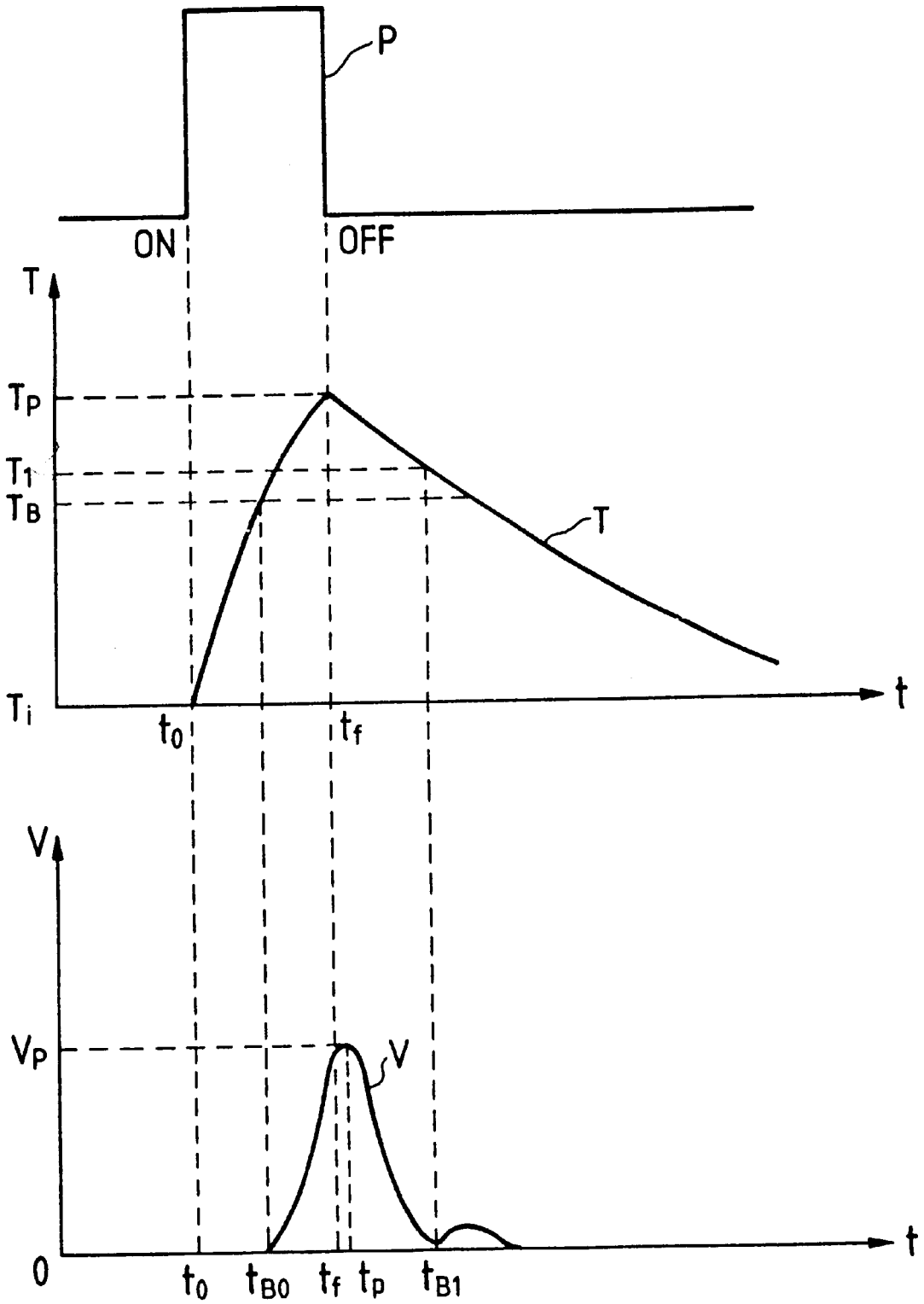
FIG. 1 PRIOR ART
FIG. 1 is a characteristic graph showing the relation between an applied pulse and the growth of a bubble.
Figure 3:
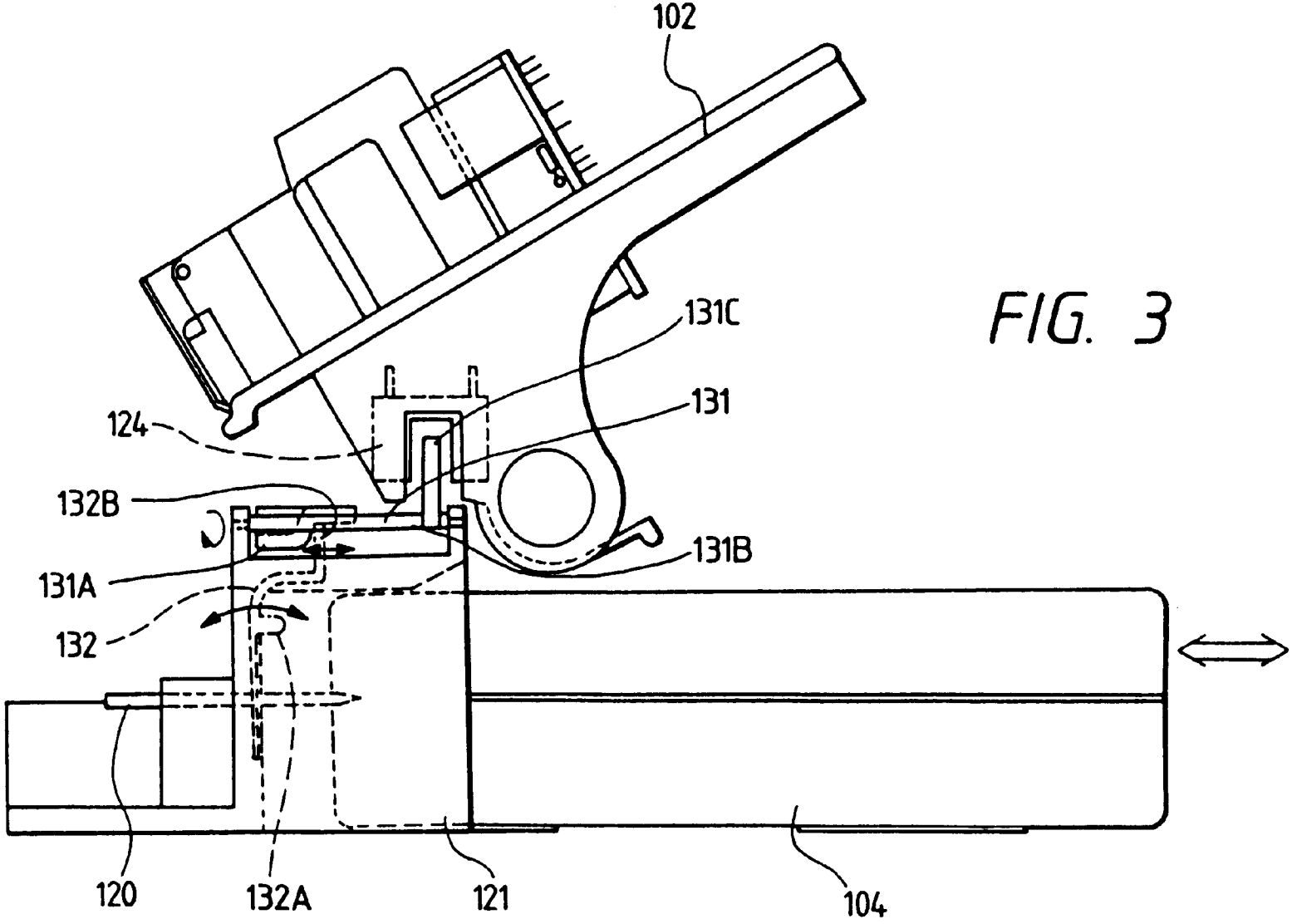
FIG. 3 shows the construction of a related ink cartridge detecting device.
Figure 5:
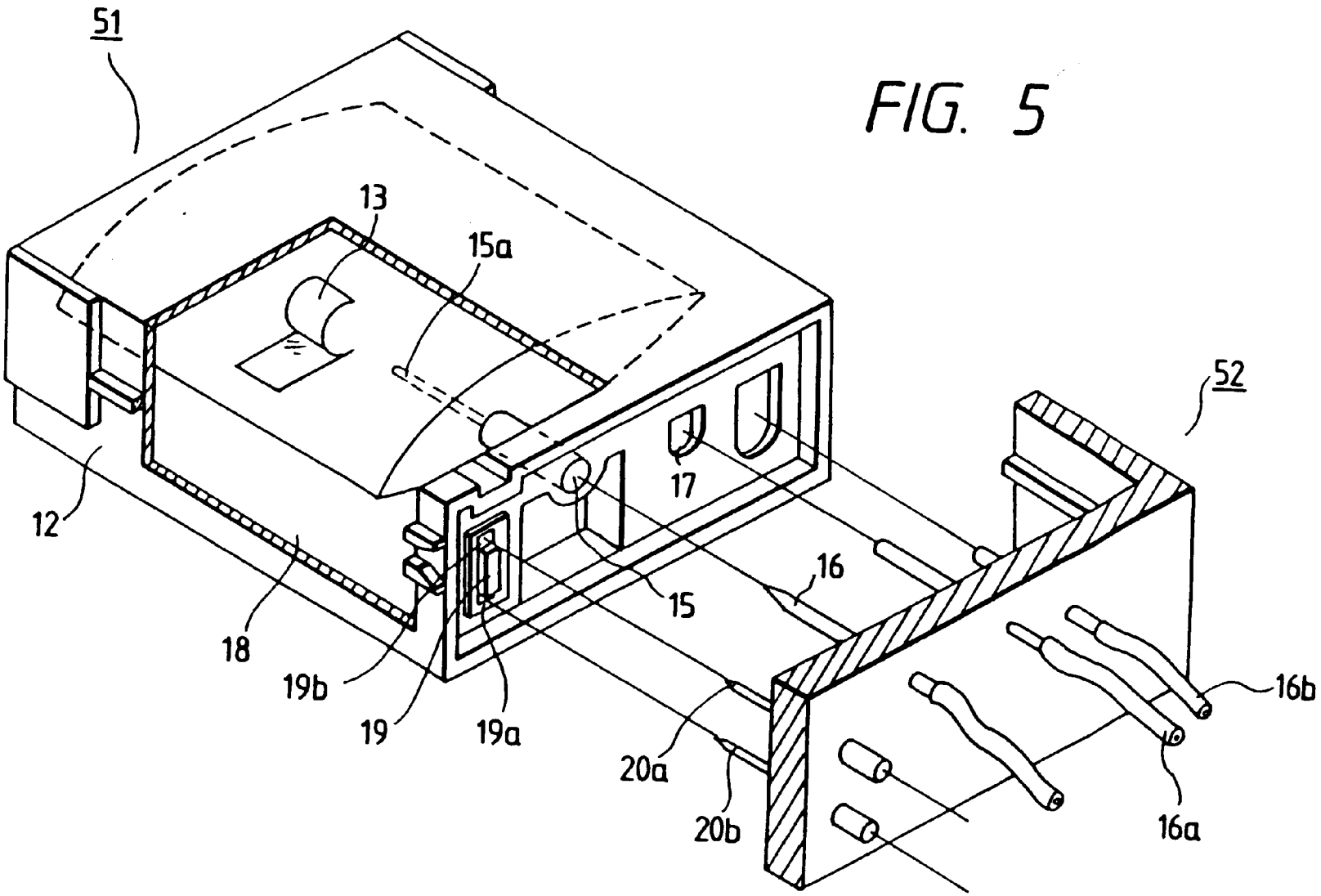
FIG. 5 is a schematic perspective view showing an embodiment of the ink cartridge according to the present invention.

FIG. 5 is partly broken-away perspective view showing an ink cartridge 51 removably mountable with respect to an ink jet recording apparatus according to the present invention, and a portion of a connecting device 52 connected to the ink cartridge 51 and provided with a supply portion for supplying ink to the ink jet recording apparatus and a supply receiving portion for receiving waste ink from the ink jet recording apparatus, the connecting device 52 being provided on the ink jet recording apparatus.

In FIG. 5, the reference numeral 12 designates the housing of the ink cartridge 51 which is usually made by plastic molding in accordance with the shape or construction of the cartridge containing portion of the ink jet recording apparatus body.

The reference numeral 13 denotes a hermetically sealed type ink container for containing ink therein. In the present embodiment, the ink container 13 uses a flexible ink bag in which ink is enclosed. The reference numeral 15 designates an ink supply portion formed of an elastic material such as silicone rubber. This ink supply portion is connected to the ink bag through an ink conducting tube 15*a*. When the ink cartridge 51 and the ink jet recording apparatus are connected together, the ink supply portion provides a portion into which a hollow ink needle 16 installed in the connecting device 52 of the ink jet recording apparatus is inserted, thereby supplying the ink in the ink bag to the ink jet recording apparatus.

Any ink forcibly discharged from an ink jet recording head by the filling of the recording head with ink, or by the recovery operation or the like of the recording head, passes through waste ink collecting tubes 16*a* and 16*b* installed in the ink jet recording apparatus body and is fed into a vast ink reservoir 18 through a hole 17 formed in the housing of the ink cartridge. The reference numeral 19 designates a medium having information indicative of the kind of the ink in the ink cartridge. The medium used in the present embodiment is a resistor (having a predetermined resistance value selected from among 0 to $\infty$ $\Omega$). The reference characters 19*a* and 19*b* denote terminals provided on a side of the ink cartridge to electrically connect the medium to the apparatus body. When the ink cartridge is completely connected to the apparatus body, these terminals 19*a* and 19*b* are electrically connected to pin terminals 20*a* and 20*b* prepared in the apparatus body. These pin terminals are electrically connected to a control circuit in the apparatus body; the control circuit can electrically read the information of these elements.

Figure 6:
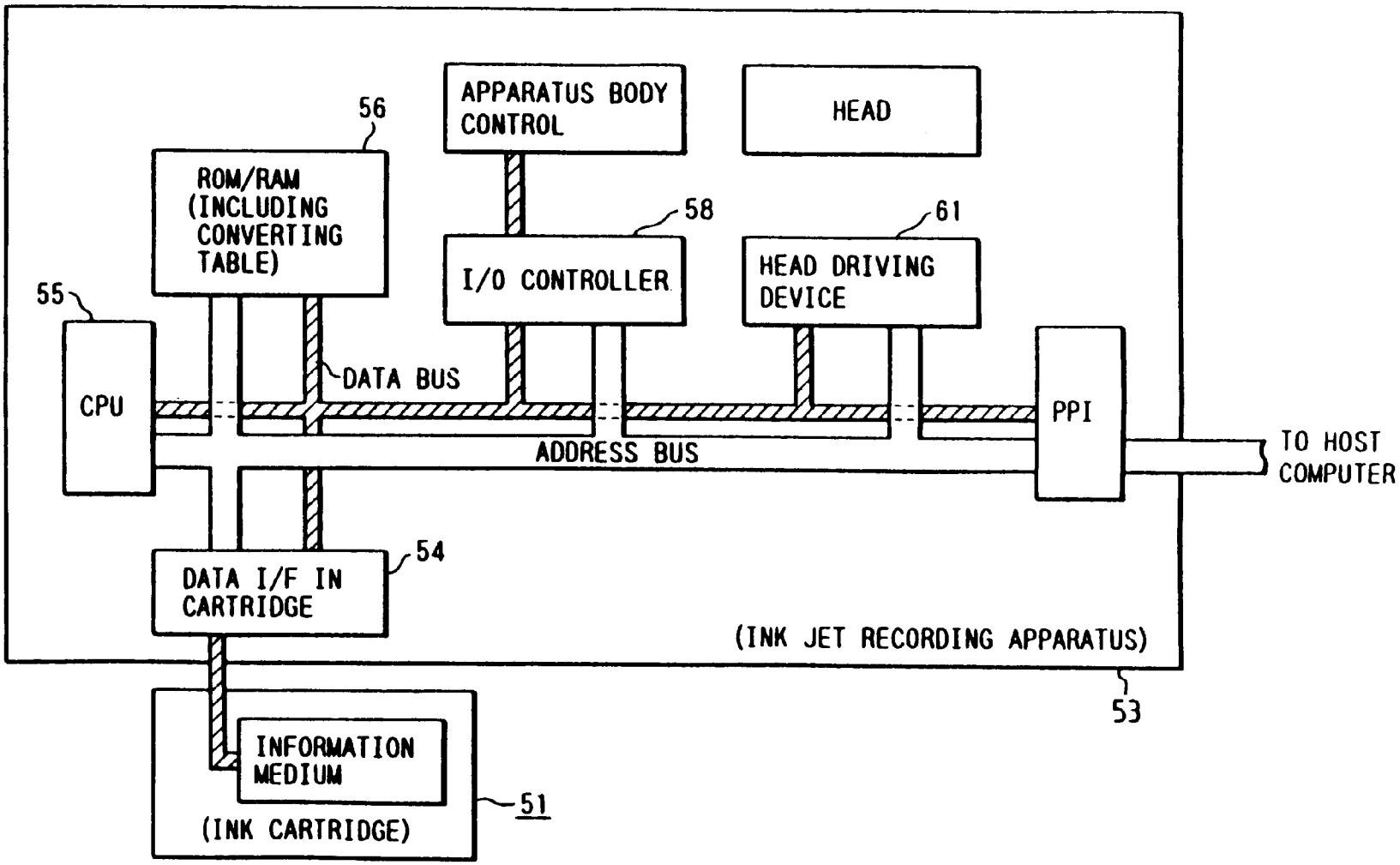
FIG. 6 is a block diagram showing a construction for controlling the driving of a recording head by the information of the ink cartridge.

FIG. 6 is a block diagram showing the manner in which the ink cartridge 51 shown in FIG. 5 is connected to the ink jet recording apparatus 53. By the ink cartridge 51 being mounted in the ink jet recording apparatus 53, the medium 19 carried on the ink cartridge is connected to the interface 54 on the side of the apparatus 53, whereby the information of the medium 19 is transmitted. On the basis of this information, control as will be described later (for example, the table of ROM 56 including a conversion table) is selected, and on the basis thereof, the driving of a recording head 59 is controlled by a head driving control device 61.

Figure 7:
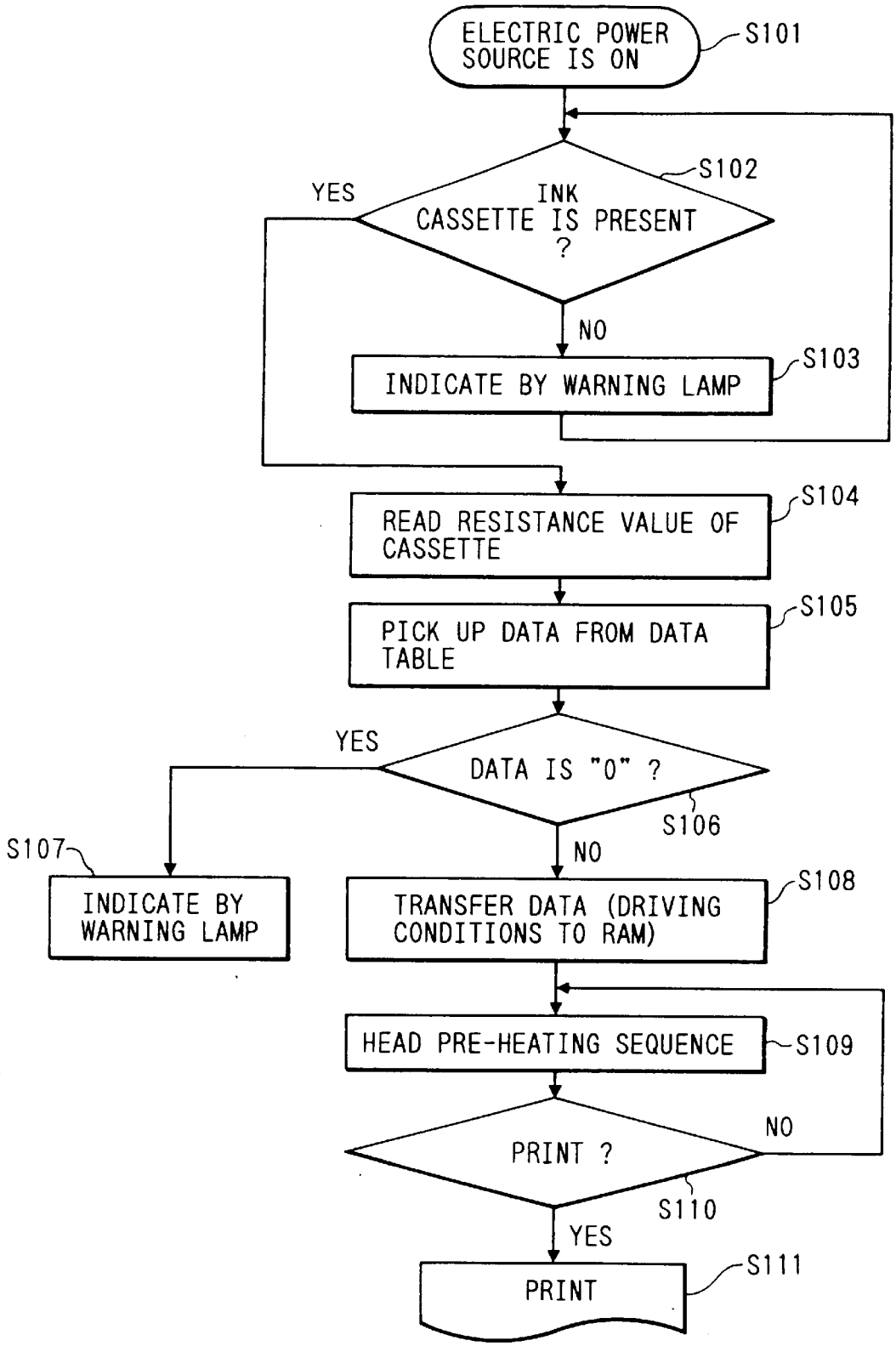
FIG. 7 is a flow chart showing an example of the sequence until printing is accomplished using the information of the ink cartridge.

FIG. 7 shows a series of operation sequences when the power source switch of the ink jet recording apparatus body is closed in a state in which the ink cartridge 51 is mounted with respect to the ink jet recording apparatus 53 shown in FIGS. 5 and 6; in this state, the terminals 19*a* and 19*b* of the medium 19 of the ink cartridge 51 are electrically connected to the pin terminals 20*a* and 20*b* on the side of the apparatus and the ink supply system is connected to the apparatus body.

At a step S101, a power source switch is closed. At a step S102, a judgment is made whether the ink cartridge is mounted with respect to the apparatus. If the ink cartridge is not mounted, a warning lamp or other operator display indicator is turned on at a step S103. If the ink cartridge is judged to be mounted, the resistance value of the medium carried on the ink cartridge is read at a step S104. At a step S105, in conformity with the read resistance value, data is read out from a data table. At a step S106, the data is judged, and if the data is absent, the warning lamp is turned on at a step S107. If the data is present, at a step S108, the data is transferred to a driving RAM. Thus, at a step S109, the recording head is driven in accordance with a predetermined table, and at a step S110, whether printing is possible or whether a printing signal is present is judged, and if printing is possible (based on the printing signal), printing is effected at a step S111. If printing is not possible, return is made to the step S109, where processing is effected to make the recording head capable of printing. Of course, the detection of the presence or absence of the ink cartridge may be effected by detecting the medium carried on the ink cartridge.

Table 3 below shows an example of the conversion table of the resistance values of the resistor on the ink cartridge and the ink jet driving conditions, etc. for those resistance values.

TABLE 3

| Resistance Value [kΩ] | Voltage [V] | Pulse Width [μs] | Frequency [Khz] | Number of preliminary discharges [times] |
|---|---|---|---|---|
| 0 | 0 | 0 | 0 | 0 |
| 0.5 | 21 | 7 | 3 | 128 |
| 1 | 21 | 7 | 4 | 128 |
| 5 | 28 | 3 | 3 | 128 |
| 10 | 28 | 3 | 4 | 50 |
| 100 | 28 | 3 | 6 | 50 |
| 200 | 28 | 2.5 | 6 | 50 |
| ∞ | 0 | 0 | 0 | 0 |

Resistance value vs. head driving conditions conversion table recorded in the ink jet recording apparatus body. This conversion table is pre-recorded in the control ROM in the ink jet recording apparatus. After the presence of the ink cartridge is confirmed, the information on the ink cartridge is read as the resistance value.

If, for example, the kind of jet recording apparatus 53 is the apparatus example I in Table 2 and the kind of the ink is the ink #2 in Table 1, and if the resistance value of the resistor on the cartridge corresponding thereto is KΩ, then the information that the driving voltage is 21 V, the pulse width is 7 μsec, the driving frequency is 4 Khz and the number of preliminary discharges is 128 is read from the conversion table (shown in Table 3) recorded in the ROM 56 by the CPU 55, and is transferred as the data during the driving of the ink jet recording head to a particular area of the RAM 56. Likewise, if the resistance value correspondence to the ink #3 is 100 kΩ, the conditions that the driving voltage is 28 V, the pulse width is 3 μsec, the driving frequency is 6 Khz and the number of preliminary discharges is 50, are read from the conversion table.

When the recording head 59 is actually driven to effect printing, the CPU 55 again indicates the aforementioned data from said determined area of the RAM to a reading head controller 58. Of course, the table differs from apparatus to apparatus, and for the ink #3 in the apparatus example II, the deriving voltage is 21 V, the pulse width is 7 μsec, the driving frequency is 3 Khz and the number of preliminary discharges is 50 times. Furthermore, if the clog preventing mechanism is a very simple device and the ink #3 is unsuitable, if the data on the conversion table in that apparatus is made to have a particular value (in this example, 0) for identification, the ink jet recording apparatus will judge that setting is impossible, and can produce an alarm. Thus, any ink which is difficult to discharge when used in a recording head having a predetermined characteristic can be automatically discriminated.

Further, if the conversion table has sufficient capacity, many expected kinds of driving conditions may be input to the conversion table, whereby there can be realized an ink jet recording apparatus which can cope with improved ink developed in the future. In the embodiment described above, description has been made with respect to an example in which reading is effected from the conversion table and the driving voltage and in which the pulse width, the driving frequency and the number of preliminary discharges are all made variable; however, it is apparent that it is also possible to form in the apparatus a circuit in simpler information (for example, only the driving voltage, only the pulse width, or only the driving frequency, or a possible combination thereof) is set by the resistance value of the resistor. Also, the information designated by the medium can include, in addition to these, the conditions of the pre-heating in which the recording head is pre-heated to improve the characteristic of the ink; conditions for the preliminary discharge in which a discharge not concerned with recording is effected to improve the recording characteristic; ink discharge conditions such that optimum discharge can be obtained during recording; ink discharge conditions when recording is effected by the use of inks of plural colors; or the discharge recovery conditions of the recording head which correspond to the ink used.

The discharge recovery conditions are performed when the discharge state has deteriorated before predetermined recording is terminated, and include, for example, a series of operations of moving the recording head to a position opposed to a cap member, thereafter causing the cap to bear against the discharge port surface, driving a pump for recovery to thereby forcibly discharge the ink from the discharge port, opening the cap, thereafter effecting idle suction for discharging the ink in the cap, and cleaning the discharge port surface of the recording head by a blade, or one of these operations or a combination of two or more of these operations. That is, the discharge recovery conditions show the selection of these operations and a condition for which these operations are performed under what degree of load, and optimum conditions are set in conformity with the characteristics of the ink. For example, for ink which is low in viscosity and easy to dry, it is necessary to set the discharge recovery operation at high frequency, and for ink which is high in viscosity and difficult to dry, the frequency of the discharge recovery operation may be set low. Here, the frequency includes not only the frequency of the recording operation, but also the operation load or the like of the recovery pump in the recovery operation. Also, the preheating conditions are necessary for bringing about ink conditions such that optimum recording can be accomplished during recording in conformity with the characteristics of the ink used. For example, as regards ink of high viscosity, it is preferable to heat such ink at a somewhat high temperature to reduce the load of the ink discharge conditions during the recording by the recording head, and adjust the viscosity of the ink.

By these various conditions being also included in the conversion table of the apparatus body, better recording can be accomplished more easily as compared with a case where a discharge conforming to the characteristic of ink is effected under only the discharge conditions.

Figure 8:
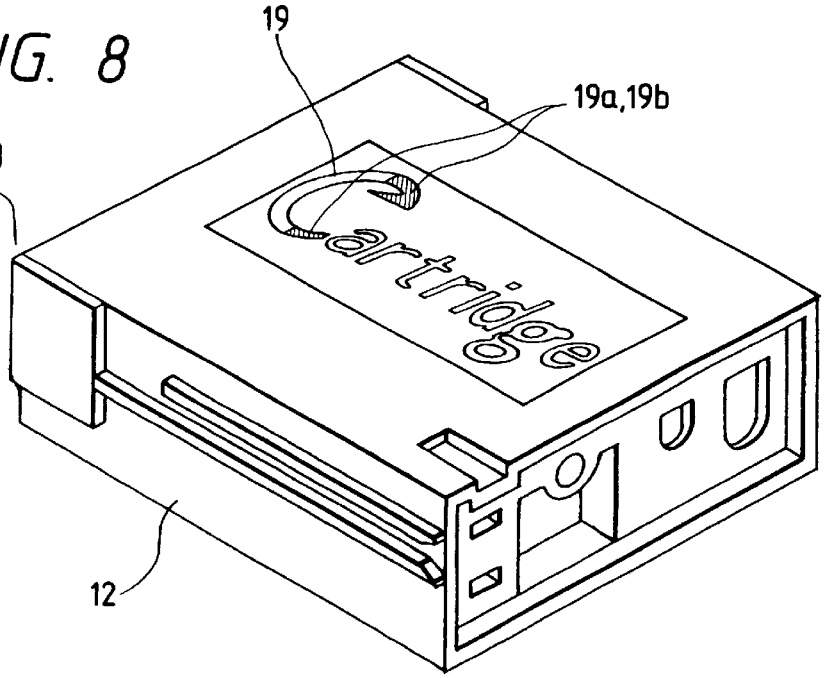
FIG. 8 is a schematic perspective view showing another embodiment of the ink cartridge according to the present invention.

As regards the form in which the resistor as the medium 19 is carried on the ink cartridge, such resistor may be provided at a predetermined location on the front face of the ink cartridge in which a collecting portion is provided. Alternatively it may be provided on the upper surface of the ink cartridge as shown in FIG. 8.

In this case, as regards the resistance value of the resistor, a resistor of different resistance value may be carried between the terminals on the side of the cartridge which are connected to the contacts on the side of the apparatus, or the expanse of the resistor can be changed, whereby the resistor may assume one of various resistance values. As a method of changing the resistance value of the resistor at this time, it is possible to utilize a logo type or the like of a predetermined shape. Also, the set resistance value may be such a value that the conversion table set in the apparatus body as previously described can be properly read out.

As a method of carrying this resistor on the ink cartridge, mention may be made of a method of forming the resistor by printing so that it may directly assume a predetermined resistance value relative to the upper surface of the cartridge, or a method of sticking a label printed with a resistor onto the cartridge so that it may assume a predetermined resistance value.

In order to mount a cartridge provided with such a resistor having a predetermined resistance value onto the apparatus, the cartridge and apparatus body are designed such that the terminal of the resistor and the terminal of the apparatus body scratch each other. This is because in some cases, a stable reading of the resistance value cannot be accomplished even if the terminals are connected together (for example, if their surfaces are oxidized with a film formed thereon); such instability can be eliminated by mounting the cartridge in such a manner that the oxidized film is scraped off.

In the foregoing, a resistor has been described as an example of the resistor carried on the cartridge, but it is also possible to use a capacitor, a diode, a coil, a battery or the like for the same purpose.

Figure 9:
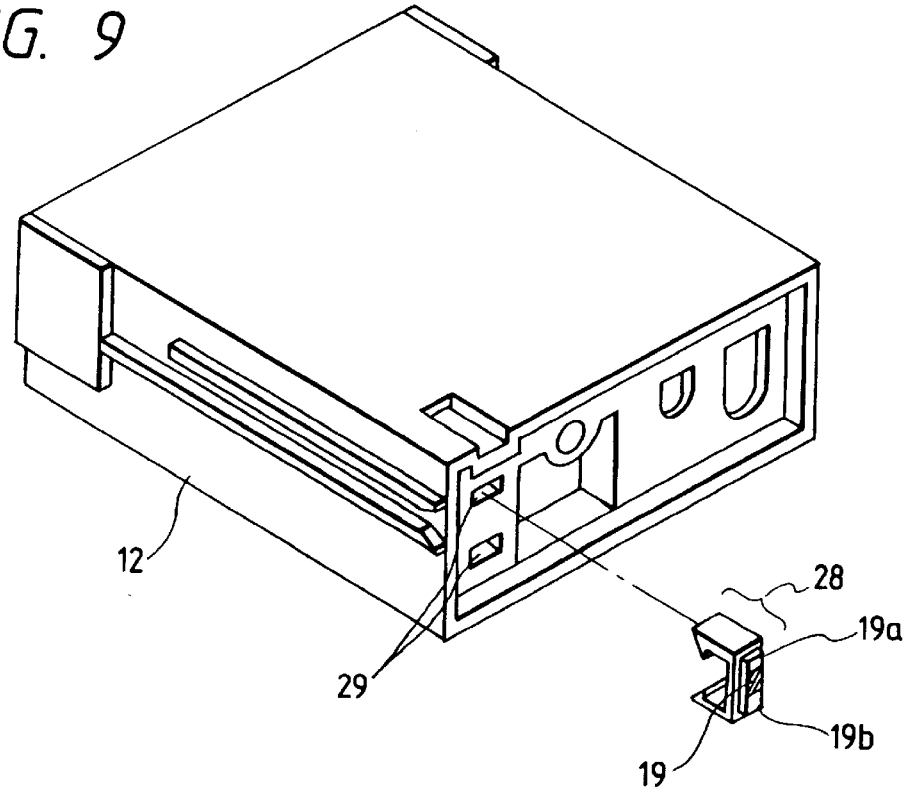
FIGS. 9 to 15 are schematic perspective views showing further embodiments.

FIG. 9 shows an embodiment of the above-described ink cartridge in which the information medium is made removably mountable. In FIG. 9, the reference numeral 28 designates a chip provided with a resistor which is an information medium. By the chip 28 being combined with the mating portion 29 of the ink cartridge, this ink cartridge becomes entirely identical in appearances and function to the ink cartridge shown in FIG. 5. Accordingly, in the manufacture of the ink cartridge of the present invention, it is unnecessary to pre-assemble and prepare the housing 12 of the ink cartridge corresponding to the kind of the ink and the element 19, and it will become easy to prevent the mixing of products if the chip 28 is mounted when the ink cartridge is filled with the ink. Efficient production thus becomes possible, so that an inexpensive and highly reliable ink cartridge is realized.

Embodiment 2

Figure 10:
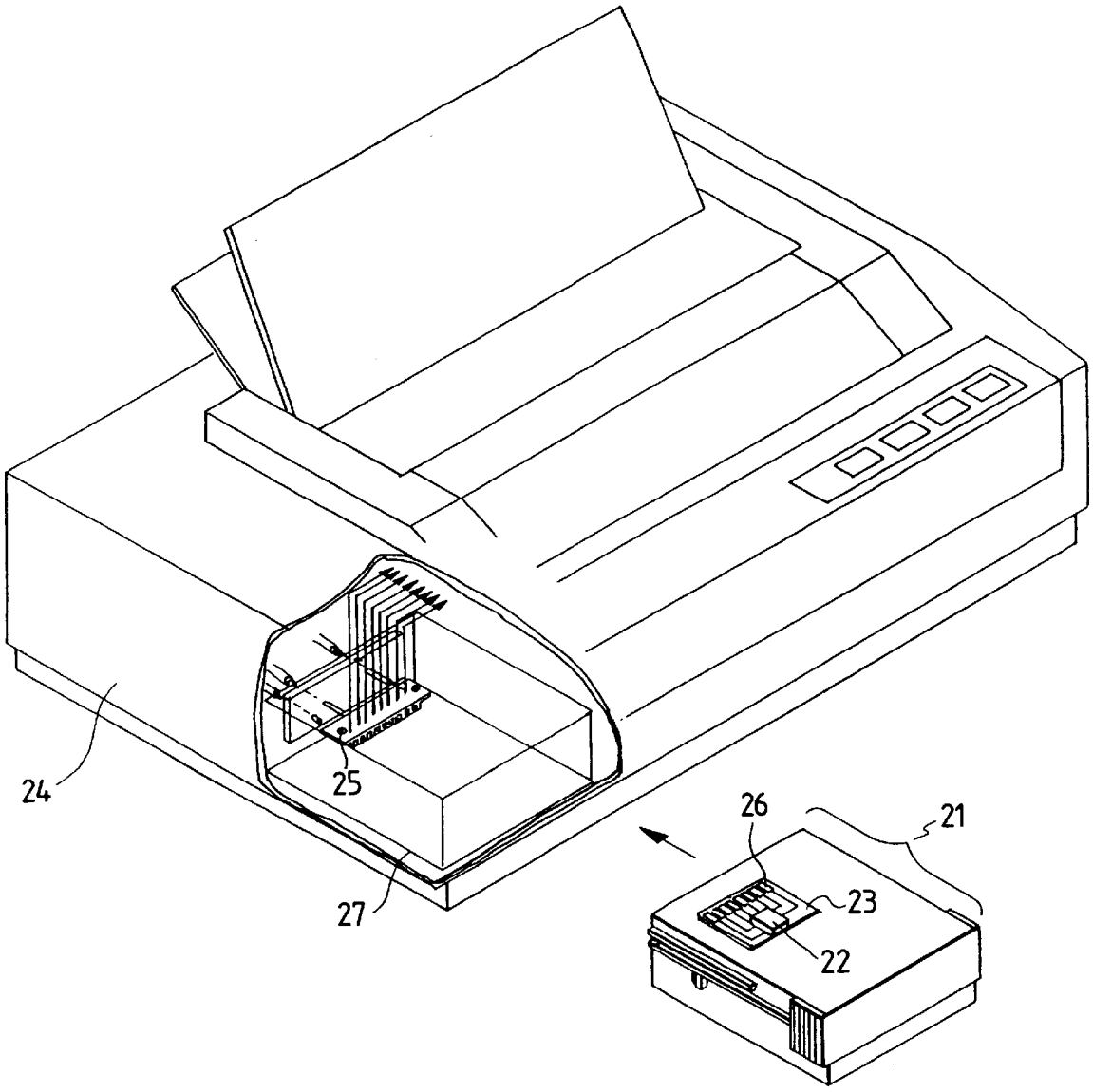

In Embodiment 1, a simple element such a resistor has been shown as the information medium, but in the present invention, a semiconductor can be employed as another example of the information medium. FIG. 10 shows an embodiment of the present invention which is provided with an electrically erasable read-only semiconductor memory array as the information medium in the ink cartridge. The reference numeral 21 denotes the ink cartridge body. The reference numeral 22 designates a semiconductor memory array. Here, the semiconductor memory array is a ROM (read-only memory), an EEPROM (electrically erasable rewritable read-only memory), a battery back-up RAM or the like. The reference numeral 23 denotes a substrate attached to and positioned accurately on the housing portion of the ink cartridge. This substrate has a terminal portion 26 for fixing the memory array thereto and electrically connecting the memory array to a connector prepared in an ink jet recording apparatus 24. As shown in FIG. 10, when the ink cartridge body is inserted into the ink cartridge receiving portion 27 of the ink jet recording apparatus 24, the connector 25 and the terminal portion 26 are electrically connected together. At this time, an ink reservoir and a waste ink reservoir are likewise connected to the connecting device of the ink jet recording apparatus.

Once the ink cartridge is inserted and the power source switch on the apparatus body is closed, the series of operation sequences are similar to those shown in FIG. 7. In the present embodiment, the memory array provided on the ink cartridge permits more information to be recorded thereon than the information medium shown in Embodiment 1 (memory arrays of 1 or more Kbyte as the lowest capacity are now commercially available); therefore, the ink jet driving conditions, the discharge recovery conditions, the pre-heating conditions, etc. are directly written therein as in the conversion table carried on the apparatus body in Embodiment 1. Accordingly, the CPU quickly transfers the information such as the ink jet driving conditions as the data during the driving of the ink jet recording head from the memory array to a particular area of the RAM after the closing of the power source switch. When the recording head is to be driven, the driving may be effected in a manner similar to that described with respect to Embodiment 1.

A feature of the present embodiment is that as previously described, the information such as the driving conditions, etc. matching the ink in the ink cartridge is recorded in the memory of the ink cartridge for each kind of ink jet recording head, and therefore a conversion table need not be prepared on the ink jet recording apparatus body. Accordingly it is unnecessary to prepare a number of conversion tables in advance. That is, in the present embodiment, even if new inks are prepared in the future, only the ROM data of the ink cartridge need be changed. The present embodiment therefore may easily be adapted for recording with future types of ink.

Figure 11:
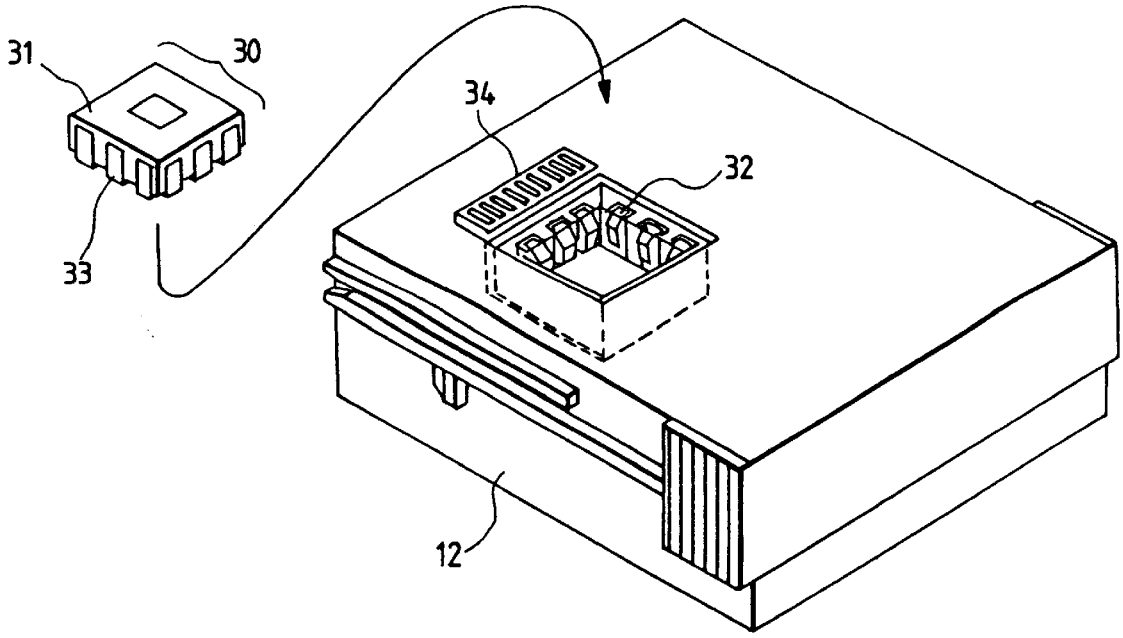

FIG. 11 shows an example of the ink cartridge in which the removably mountable information medium incorporates the memory array as described in connection with FIG. 10. In FIG. 11, the reference numeral 30 designates a semiconductor memory array such as ROM, EEPROM or a battery back-up RAM. The semiconductor memory array 30 has on the housing 31 thereof a terminal 33 for electrically connecting the memory array to the connector 32 of the ink cartridge. The reference numeral 34 denotes a terminal for electrically connecting the ink jet recording apparatus body to the memory array. Accordingly, in this embodiment, it is apparent that an effect similar to that of the embodiment shown in FIG. 9 is obtained.

Embodiment 3

Figure 12:
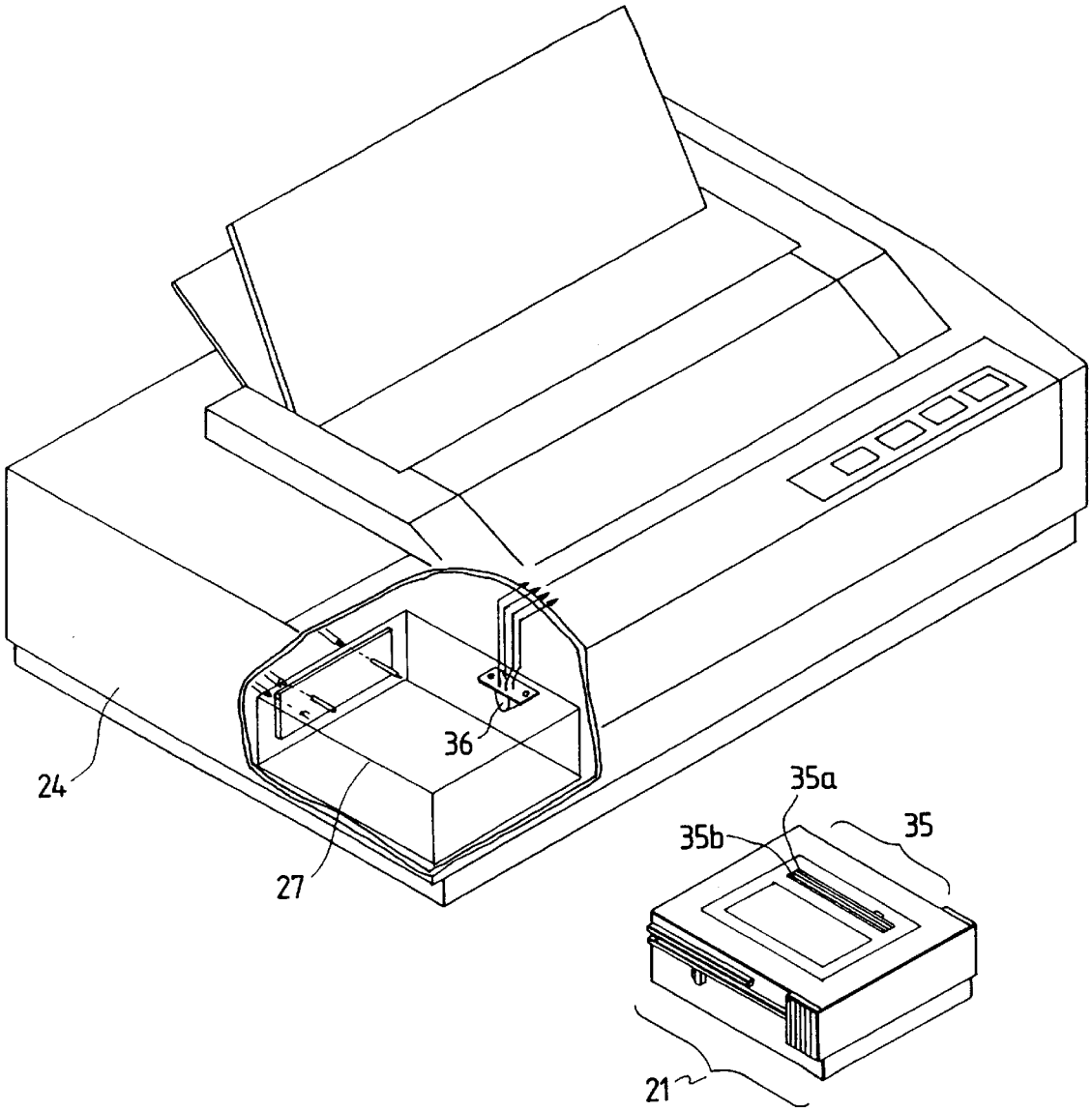

FIG. 12 shows another embodiment of the present invention in which information (such as the ink jet recording head driving conditions) is recorded in a memory on the ink cartridge located parallel to the direction of insertion of the ink cartridge into the ink jet recording apparatus. The reference numeral 35 designates a magnetic tape on which the information such as the ink jet driving conditions is recorded at 35*a*, parallel to the direction of insertion of the ink cartridge, by variations in magnetization polarity, density, etc. Also, in order to prevent unsatisfactory reading of the information caused by a change in the insertion speed, exclusive tracks in which timing information is written at predetermined intervals are set at 35*b*, parallel to the track in which the aforementioned information is written.

As shown in FIG. 12, the information (such as the ink jet head driving conditions) recorded on the magnetic tape is successively read by a reading head 36 when the ink cartridge is inserted into the ink jet recording head body. After this information is transferred to the RAM area in the ink jet recording apparatus body, the ink jet recording head can be driven on the basis of this information in the same manner as in the embodiment shown in FIG. 10.

Embodiment 4

Figure 13:
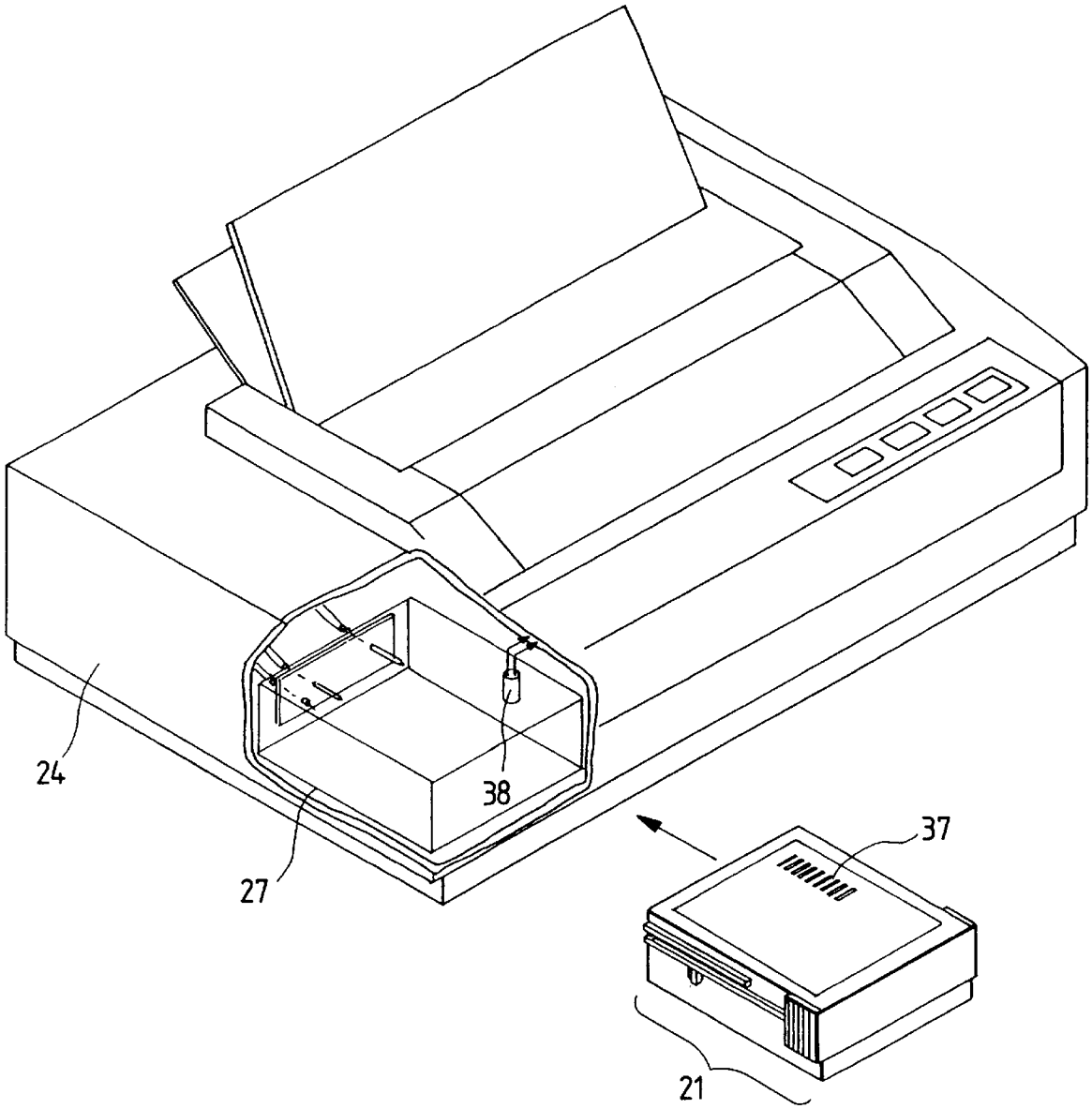

FIG. 13 shows another embodiment, in which the method of recording information on the ink cartridge differs from the embodiment shown in FIG. 12. In the present embodiment, information such as the ink jet driving conditions is encoded as a bar code 37 stuck to the housing portion of the ink cartridge, in place of the magnetic tape shown in the previous embodiment. Again in this case, as in the previous embodiment, the information such as the recording head driving conditions is successively read by a reading head 38 when the ink cartridge is inserted into the ink cartridge receiving portion 27 of the ink jet recording apparatus. In the present embodiment, the recording information medium need only be printed as a bar code, so that the medium can be manufactured relatively easily and an inexpensive ink cartridge can be provided.

Embodiment 5

Figure 14:
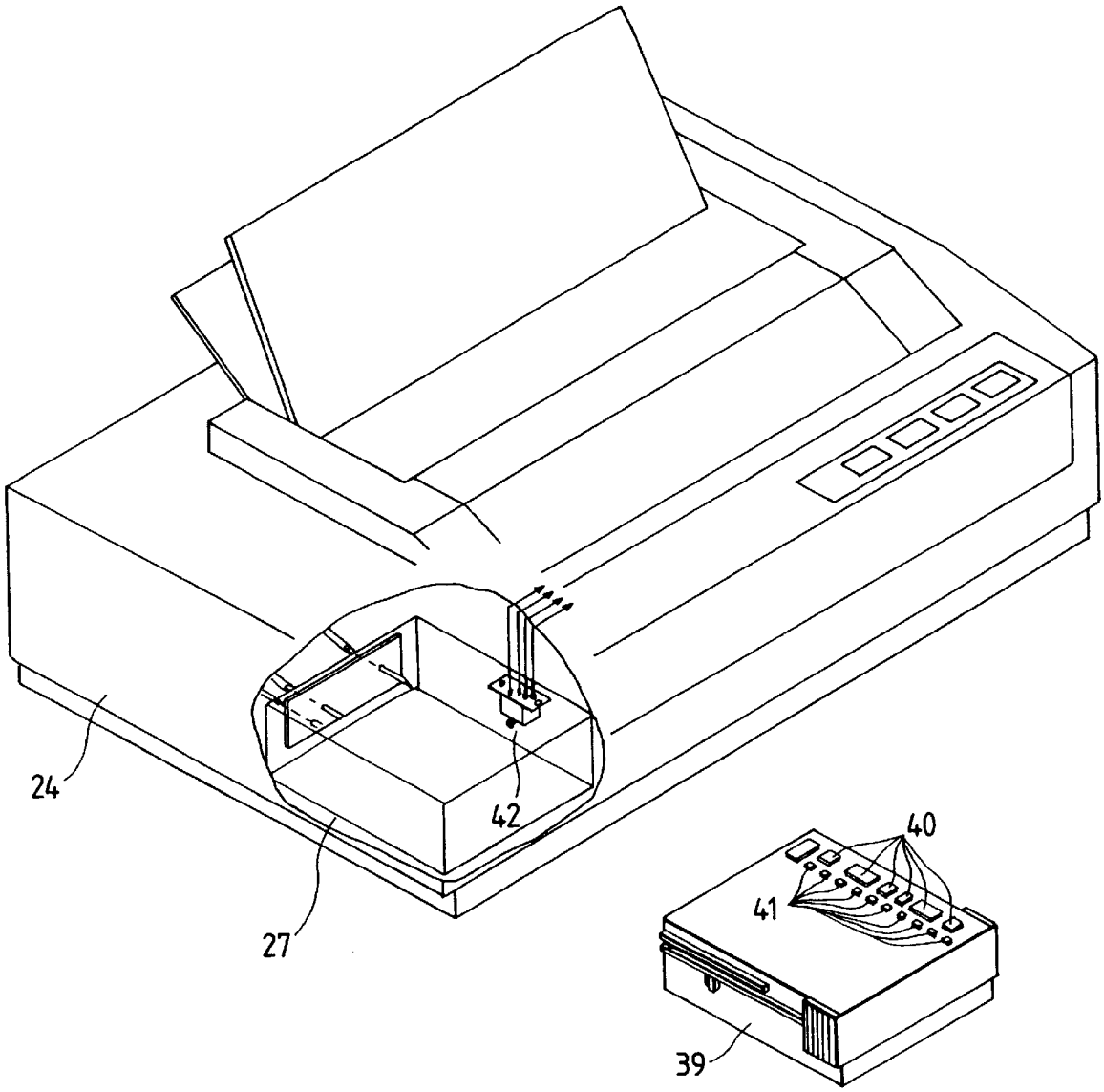

FIG. 14 shows another embodiment, in which the method of recording information on the ink cartridge differs from the embodiment shown in FIG. 13. In FIG. 14, the reference numeral 39 designates an ink cartridge, and the reference numeral 40 denotes a three-dimensional information pattern disposed on the housing of the ink cartridge. The information pattern 40 is molded integrally with the housing of the ink cartridge. The reference numeral 41 designates a three-dimensional information pattern for timing information. As shown in FIG. 14, information such as the ink jet recording head driving conditions is recorded on the three-dimensional information pattern, and is successively read by a reading cam switch 42 when the ink cartridge is inserted into the ink cartridge receiving portion 27 of the ink jet recording apparatus. After this information is transferred to the RAM area in the ink jet recording apparatus body, the ink jet recording head can be driven on the basis of this information in the same manner as in the embodiment shown in FIG. 10.

Embodiment 6

Figure 15:
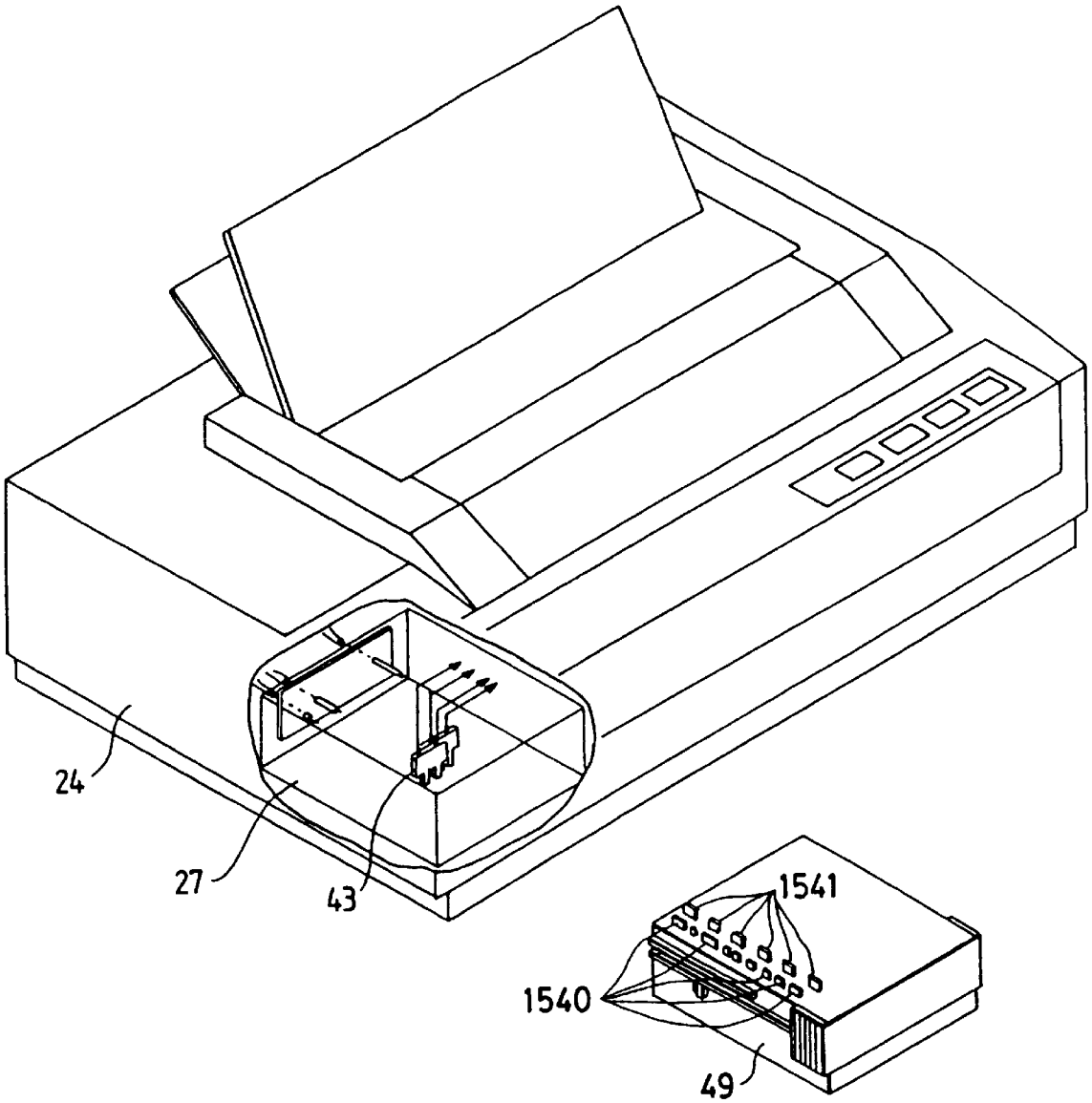

FIG. 15 shows another embodiment, in which the method of recording information on the ink cartridge differs from the embodiment shown in FIG. 14. In FIG. 15, the reference numeral 49 designates an ink cartridge, and the reference numeral 1540 denotes a three-dimensional information pattern disposed on the housing of the ink cartridge 49. The information pattern 1540 is molded integrally with the housing of the ink cartridge. The reference numeral 1541 designates a three-dimensional information pattern for timing information. In the embodiment shown in FIG. 15, the information such as the ink jet head driving conditions so recorded in the three-dimensional information pattern is successively read by the photoelectric switch 43 of the ink jet recording head body when the ink cartridge is inserted into the ink jet recording apparatus. After this information is transferred to the RAM area in the ink jet recording apparatus body, the ink jet recording head can be driven on the basis of this information.

Figure 16:
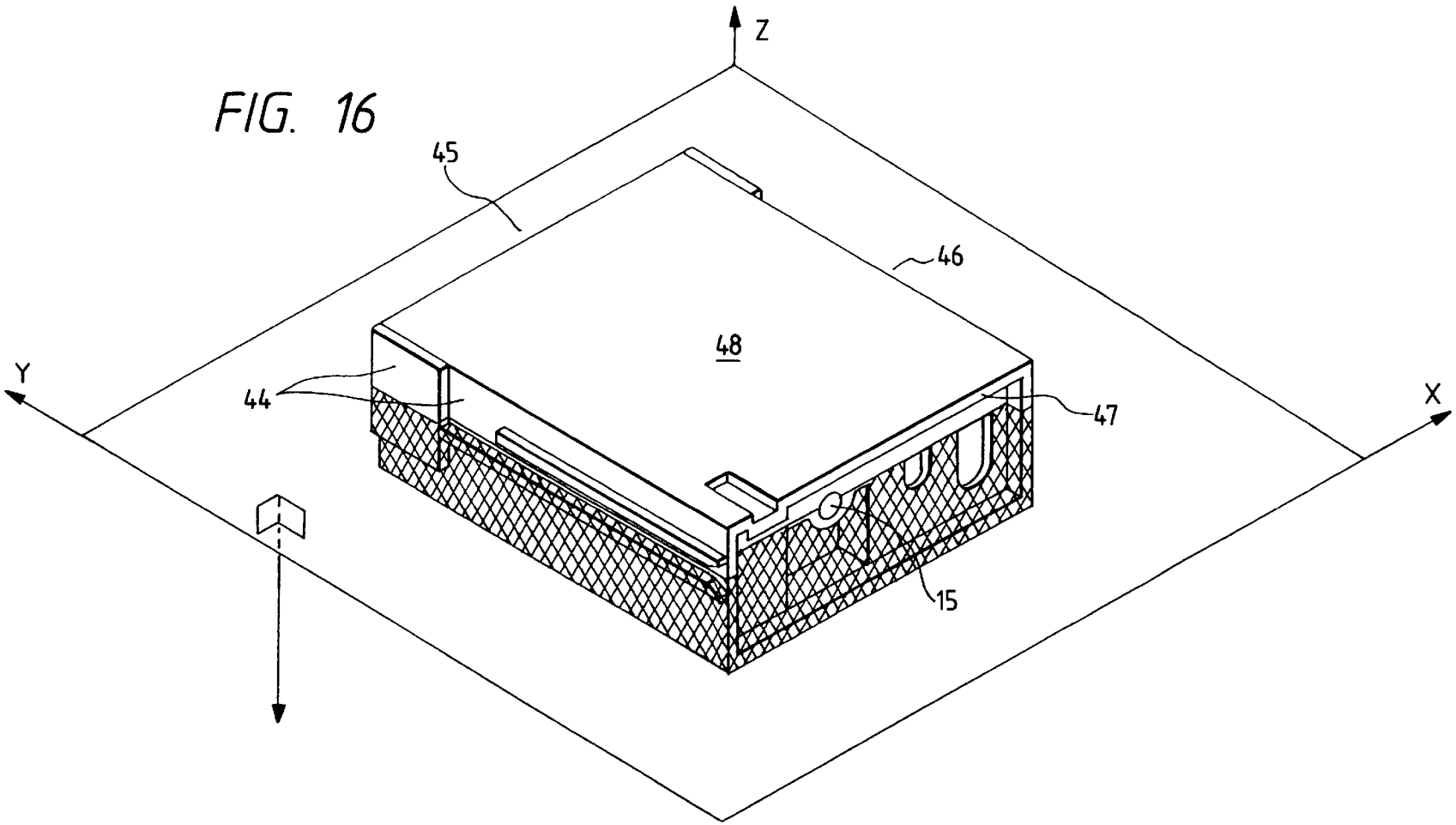
FIG. 16 is a schematic perspective view showing the installed position of a medium carried on an ink cartridge.

As shown in FIG. 16, the medium for transmitting the information by the above-described various systems may preferably be disposed, for example, above the ink connecting portion between the ink cartridge and the recording apparatus with respect to the direction of gravity. That is, it is preferable that (as shown on the surfaces 44–48 on the cartridge in FIG. 16) the information medium or the information delivery portion between the information medium and the ink jet recording apparatus body be positioned above the level line of the ink supply portion 15, which is the ink connecting portion between the ink cartridge and the ink jet recording apparatus.

If the information medium or the information delivery portion between the information medium and the ink jet recording head is so provided above the ink connecting portion with respect to the direction of gravity, the ink flows downward along the direction of gravity and away from the medium even if it leaks from the ink connecting portion, and therefore the medium can be prevented from being wetted by the ink. Thus, adverse effects such as electrical leaks, corrosion of the terminal portion and unsatisfactory operation of the sensor caused by slight leakage of the ink during the mounting or dismounting of the ink cartridge can be minimized.

Figure 17:
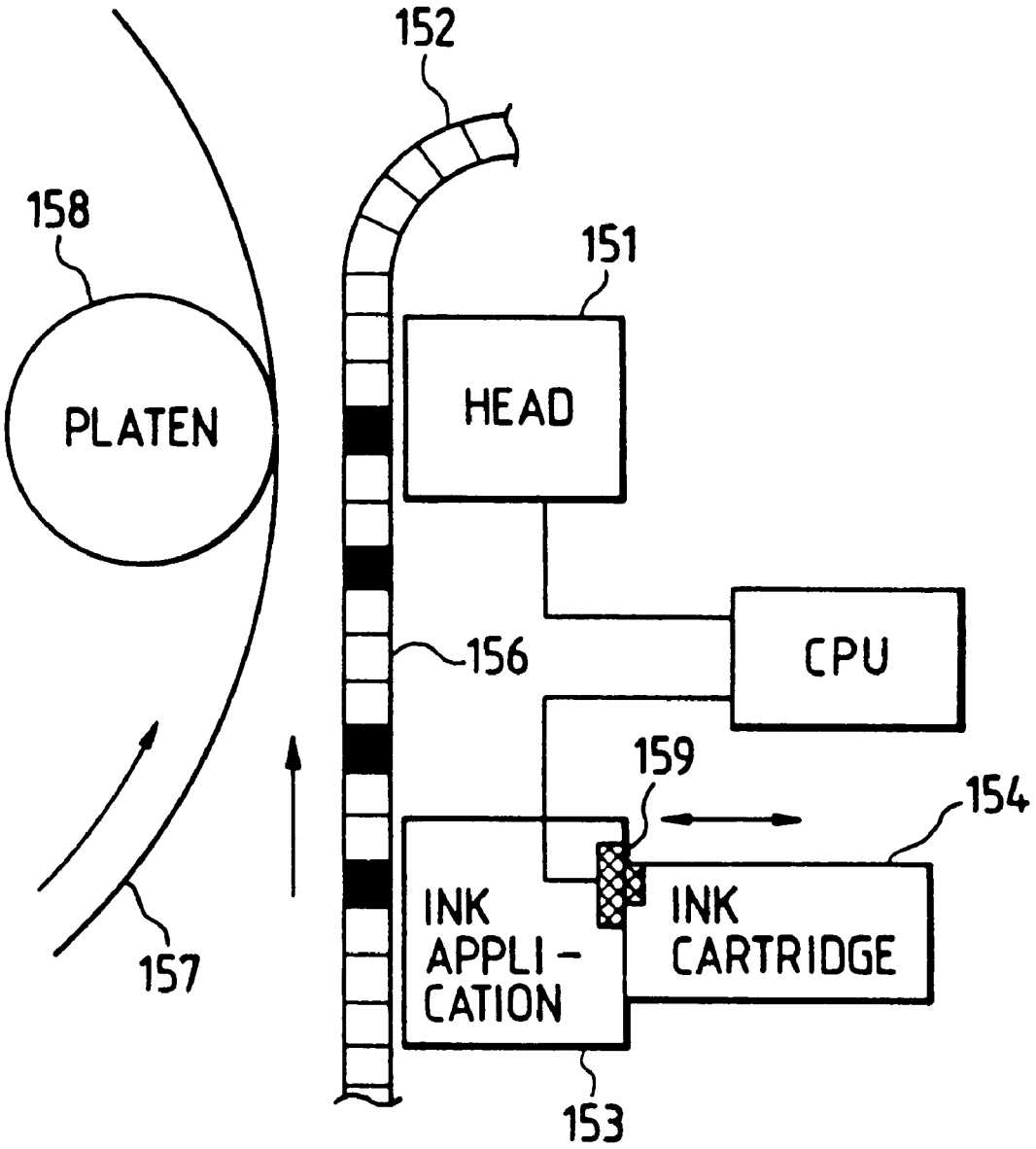
FIG. 17 is a schematic view showing an example of the ink jet recording apparatus.

As shown in FIG. 17, the ink cartridge 154 of the present invention can also be applied to an ink cartridge for supplying ink to the ink imparting portion 153 of an apparatus of the type in which, when an ink retaining member 152 passes through the ink imparting portion, a hole or recess 156 formed in the ink retaining member 152 is filled with ink. When the ink reaches the surface of the hole or recess 156 in the ink retaining member 152 filled with ink or the surface of a recording head 151, a desired voltage is applied to the recording head 151 to thereby discharge the ink and form an image on a recording medium 157 disposed opposite to the recording head 151 and moved on a platen 158.

In this case, as in each of the above-described embodiments, control can be effected such that the various kinds of information given to the cartridge 154 are transmitted by the interface 159 between the ink imparting portion 153 and the cartridge and a processing table based on the information is selected to thereby effect predetermined driving of the head 151.

Embodiment 7

Figure 18:
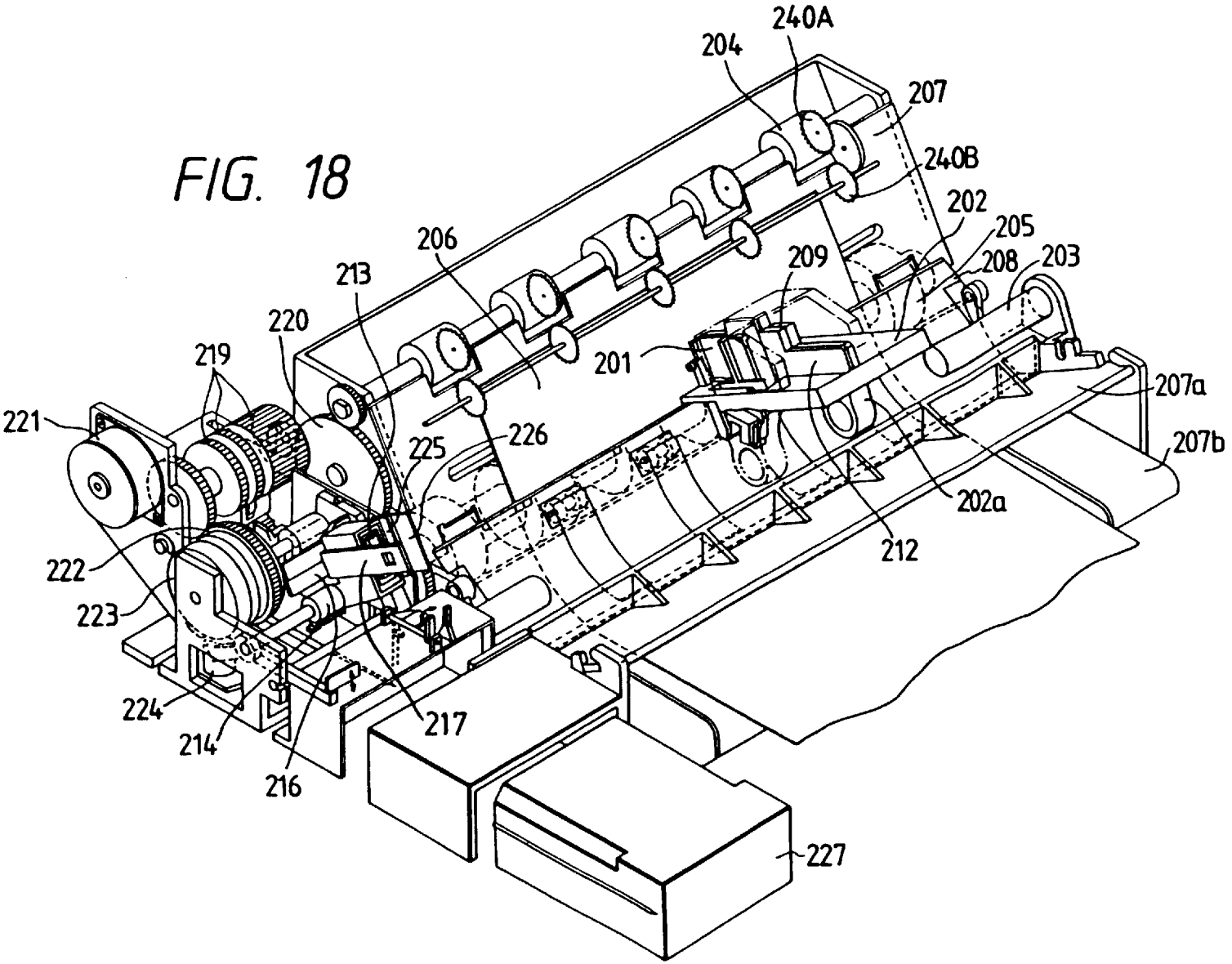
FIG. 18 is a perspective view showing an ink jet recording apparatus according to an embodiment of the present invention with the top cover thereof removed.
Figure 19A:
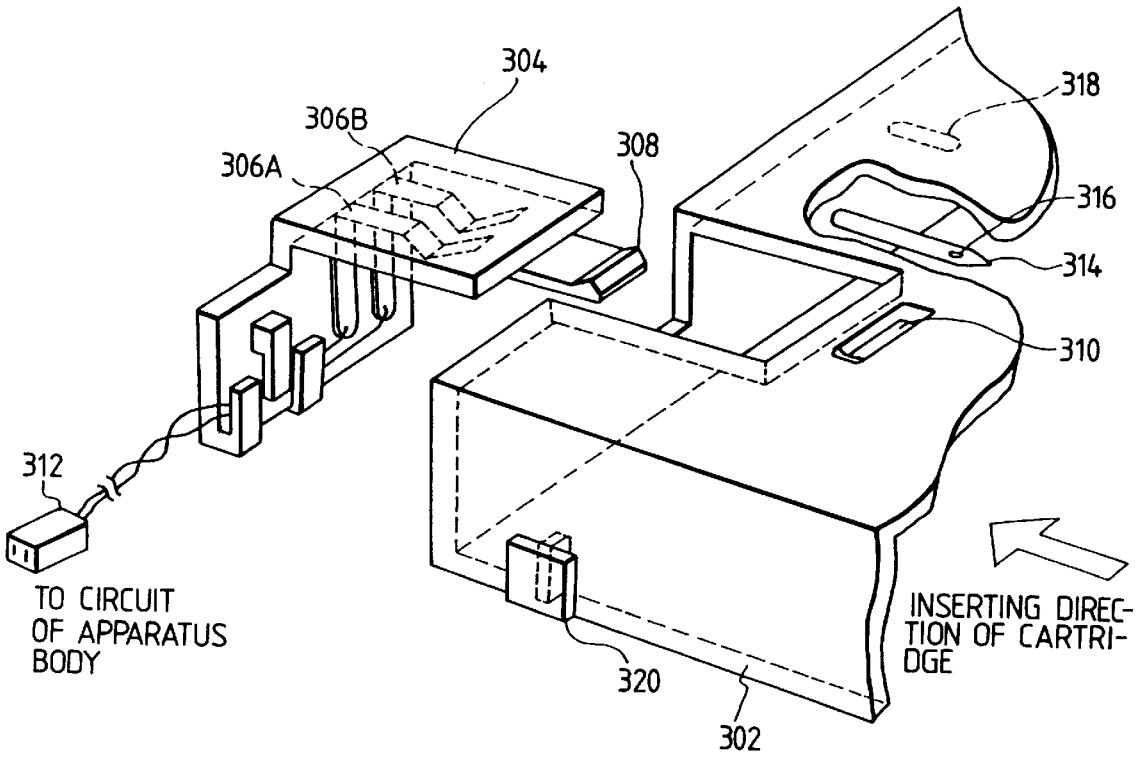
FIGS. 19A and 19B are perspective and fragmentary cross-sectional views, respectively, showing an example of the construction of the ink cartridge mounting portion of the apparatus according to the present invention.
Figure 19B:
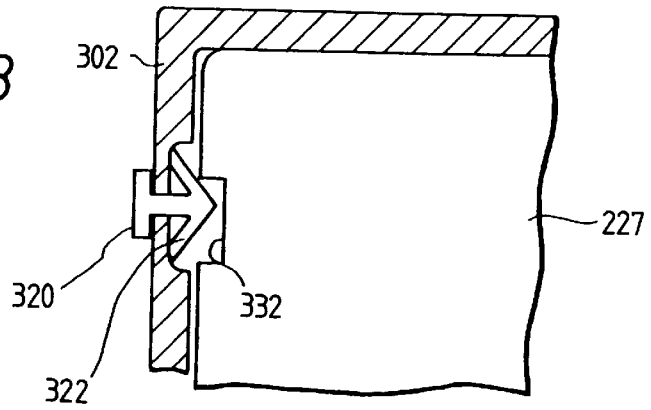

The ink cartridge carrying thereon an information medium in the form as previously described has a construction as shown, for example, in FIGS. 19A and 19B, and can be applied to a bubble jet recording apparatus which is shown in FIG. 18 with its cover removed.

In FIG. 18, the reference numeral 201 designates an ink jet recording print head in the form of a chip, and the reference numeral 202 denotes a carriage carrying the recording head 201 thereon and which moves so as to scan the recording head 201. On the carriage 202, as will be described later, there are provided a support member for removably carrying the recording head 201 thereon, and a cover member (indicated by dot-and-dash line) forming a part of the recording head 201 and protecting a substrate printed with a head driving circuit or the like.

The recording head 201 has 64 discharge openings disposed in the front end portion thereof, and an ink liquid path communicating with each of these discharge openings is provided. Further, behind the region in which the ink liquid paths are disposed, there is provided a common liquid chamber for supplying ink to these liquid paths. In the ink liquid paths corresponding to the 64 discharge ports, there are provided electro-thermal conversion elements generating thermal discharge energy available to eject the ink liquid from these discharge ports and electrode wiring for supplying electric power to the electro-thermal conversion elements.

These electro-thermal conversion elements and electrode wiring are formed on a substrate formed of silicon or the like by film-forming techniques; partition walls, a top plate, etc. formed of resin or a glass material are layered on this substrate. The discharge openings, ink liquid paths and common liquid chamber are thereby constructed. Further rearwardly of this arrangement in the recording head 201, a driving circuit for driving the electro-thermal conversion elements on the basis of a recording signal is provided in the form of a printed substrate.

In the carriage 202, rearwardly of the above-described recording head 201, there is disposed a connector substrate 212. On the connector substrate 212, there are disposed a connector 209 for connection to the recording head 201 and a connector for connection to a flexible cable from the control circuit in the apparatus body. Also, a capacitor, a resistor, etc. are mounted on the connector substrate 212, and by these, the drop of the power source voltage supplied through the flexible cable and the mixing of noise with a signal are compensated for. Further, the connector substrate 212, as will be described later, is supported on a slide member so that it may slide with the opening-closing movement of the cover member and the connector 209 may be connected to the terminal of the recording head 201.

The carriage 202 is slidably and pivotably engaged with a guide shaft 203 through an engagement portion 202*a*, and the guide shaft 203 is provided over an area longer than the width of recording paper so as to be orthogonal to the direction in which a recording medium such as recording paper is conveyed. Also, the carriage 202 is connected to a portion of a belt, not shown, extended parallel to the guide shaft 203. This belt is driven by a carriage motor, not shown, thereby enabling movement of the carriage 202 along the guide shaft 203, i.e., the scanning movement of the recording head 201. Also, the carriage 202 and the recording head 201 obtain the force for pivotally moving about the guide shaft 203 from their own gravity, and with this force as a biasing force, they bias a paper keep plate 208 (to be described below) through a slide member provided on the carriage 202 for sliding on the paper keep plate. The recording head 201 thus can keep a predetermined spacing between it and the recording paper used, in accordance with the thickness of the recording paper.

The recording paper 206 is fed from a paper supply cassette, not shown, or is fed manually, and is supplied to the apparatus body through a paper supply port comprised of an upper paper guide 207*a* and a lower paper guide 207*b*. The paper keep plate 208 has a curvature and is continuous with the extension of the upper paper guide 207*a*. The paper keep plate 208 is disposed so as to press the recording paper against a paper feeding roller 205, and is formed of such a material that the frictional force created between the paper keep plate and the recording paper during the pressing is smaller than the frictional force created between the paper feeding roller 205 and the recording paper. Also, the lower paper guide 207*b* extends to the region in which the paper feeding roller 205 is disposed parallel to the paper keep plate 208.

Thus, the recording paper 206, fed from the paper supply port, is conveyed one line at a time upwardly in the apparatus with the rotation of the paper feeding roller. At this time, the recording paper 206 slides on a plate-like platen 207 while the spacing between it and the recording head 201 is regulated to a predetermined amount by the paper keep plate 208 and the platen 207.

The recording head 201, with its scanning movement, ejects ink droplets to the recording area of the recording paper 206 opposed thereto to thereby effect recording of one line. By this recording, and by the conveyance of the recording paper for the one line, recording of each one line is sequentially effected, whereby characters, images or the like are formed. The recording paper 206 on which recording has been effected, with the conveyance thereof, is discharged onto a paper discharge tray, not shown, by paper discharge rollers 204 and spurs 240A and 240B provided above the recording paper conveyance path. Five pairs of such spurs 240A and 240B are provided correspondingly to the paper discharge rollers 204, and a spur cleaner is interposed between each pair of spurs. A member for supporting these spurs and spur cleaners is not shown in FIG. 18. The spurs 240A are designed to impart a pressure force to the paper discharge rollers 204 with the recording paper interposed therebetween, and the spurs 240B are designed to regulate the recording paper conveyance path between them and the platen 207. The paper discharge rollers 204 are rotatively driven so that their rotational speed is greater than that of the paper feeding roller 205; the recording paper 206 in the portion thereof constituting the recording area is thereby pulled upwardly and thus, the recording paper 206 can be prevented from floating up from the platen 207.

Near the home position in the area continuous to the scanning area of the recording head 201, there are provided a series of subassemblies used in the discharge recovery process. That is, there are provided a blade 226 for removing water drops, dust, etc. from the discharge port surface in which the discharge ports are disposed by the wiping movement thereof, an absorbing portion 225 for removing water drops, etc. from the discharge port surface chiefly by absorbing them, and a cap 213 which effects hermetic sealing of the discharge port surface, idle discharge and ink absorption. These members are designed to be movable back and forth relative to the moving area of the recording head 201 while being supported as a unit by a moving support member 214, and perform their respective operations with an appropriate timing. Also, ink absorption in the cap 213 is effected by a pump 224 communicating with the cap 213 through a hollow portion of the moving support member 214 and a tube. During the capping by the cap 213, a hole formed in a cap arm 217 mounted on a side of a holding member for the cap 213 and a projecting portion provided on the carriage 202 are engaged with each other, so that the recording head 201 is precluded from rotating rearwardly, thereby ensuring the capping of the discharge port surface by the cap 213.

The rotation of the paper feeding roller 205 and the paper discharge rollers 204, and the operations in the discharge recovery mechanism (i.e., the back and forth movement of the cap 213, the blade 226 and the absorbing member 225 as a unit and the absorbing operation by the pump 224), are performed by using the rotational driving force of a feed motor 221. The driving force of the feed motor 221 mounted on a portion of the apparatus body frame is first transmitted to a transmission switching gear train 219. In this gear train 219, the selection and switching of each gear is effected by the movement of a selection gear (not shown) operatively associated with the movement of the carriage 202 (i.e., the scanning movement by the recording head 201), the movement to the home position or to the discharge recovery device, and the stoppage at these positions. The rotation of each gear in the gear train 219 is transmitted to the paper feeding roller 205 and the paper discharge rollers 204 through an intermediate feed gear 220, and transmitted to the cap 213, etc. finally through a cam 216, and further transmitted to the pump 224 through a pump gear 222 and a pump cam 223.

Ink is supplied to the recording head 201 from an ink cartridge 227 removably mounted in a mounting receptacle in the recording apparatus body, through a flexible tube capable of following the movement of the carriage 202. Also, the position of the carriage 202 during its movement is detected by counting the number of steps of the carriage motor, with the position of engagement between a home position sensor 211 provided on the carriage 202 and a home position detecting flag provided near the end of the movement area of the carriage 202 as the reference.

Description will now be made of the construction of the ink cartridge 227 according to the present embodiment and the construction of the mounting portion on the apparatus body on which the ink cartridge is mounted.

FIGS. 19A and 19B show an example of the construction of the mounting portion.

First, in FIG. 19A, the reference numeral 302 designates a cartridge inserting portion for receiving the insertion of the ink cartridge 227. The reference numeral 304 denotes a contact holder for holding leaf spring-like electric terminals 306A and 306B as means for reading the information provided on the ink cartridge 227. The contact holder 304 is combined with the inserting portion 302 by a latch portion 308 engaging with a hole 310 in the inserting portion 302. The reference numeral 312 designates a connector for connecting the terminals 306A and 306B to a control unit in the apparatus body.

The reference numeral 314 denotes a hollow needle member which enters the interior of a bag containing ink to be supplied; the bag is contained in the ink cartridge 227. The hollow needle member 314 is formed with an ink conducting aperture 316 in the tip end portion thereof. An ink supply tube is mounted on the other end of the needle 314, and the tube is connected to a common liquid chamber portion provided on the recording head 201. Means for detecting the amount of remaining ink can be provided within this ink supply system.

The reference numeral 318 denotes a waste ink pipe, for directing waste ink to an ink absorbing member, which enters the ink cartridge 227 and is contained therein. The waste ink is ink not used for recording; for example, ink discharged during the ink refreshing process (for example, in the ink supply system or the common liquid chamber), or ink discharged during the recovery process.

The reference numeral 320 designates a clip as a fastening means or locking member for the ink cartridge 227. One clip 320 is provided on each side of the inserting portion 302. These clips 320, as shown in FIG. 19B, receive the insertion of the cartridge 227 by an engagement portion 322 which resiliently flexes with the engagement thereof with a side of the cartridge 227 during the insertion of the cartridge 227, and hold the cartridge 227 in that position by the engagement portion 322 returning to its original shape when a recess 332 in the cartridge 227 reaches the clips.

Figure 20:
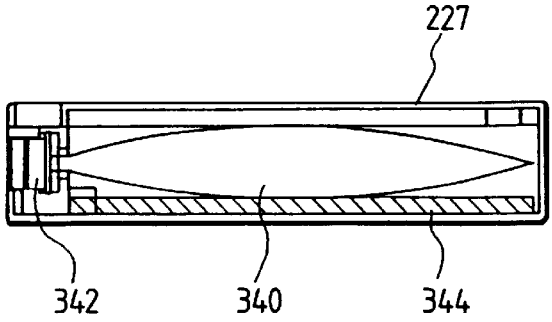
FIG. 20 is a cross-sectional view showing an example of the construction of an ink cartridge according to an embodiment of the present invention.

FIG. 20 shows an example of the construction of the ink cartridge 227 according to the present embodiment.

In FIG. 20, the ink cartridge comprises a container having therein an ink bag that provides a reservoir 340 containing therein liquid ink to be supplied to the print head. The ink bag 340 is provided with a stopper member 342 made, for example, of rubber. The needle 314 is inserted into this stopper member 342 and further enters the interior of the ink bag, whereby ink communication is accomplished. The reference numeral 344 designates an absorbent waste ink collecting member for receiving the above-mentioned waste ink. The above-described medium for transmitting the characteristics of the ink in the cartridge is attached to a portion of a side or the upper surface of the ink cartridge 227.

Figure 21:
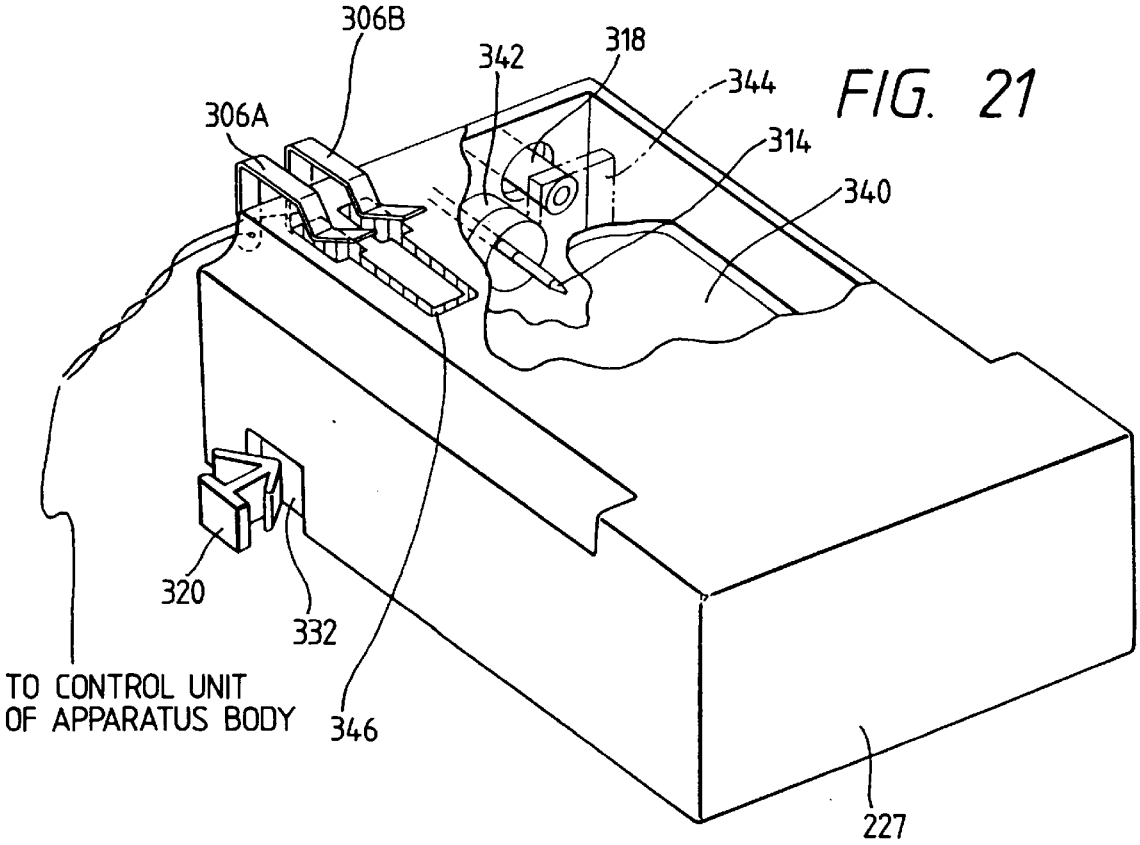
FIG. 21 is a perspective view for illustrating each portion for effecting the mutual coupling between the ink cartridge and the side of the apparatus body.

FIG. 21 illustrates each portion for coupling the ink cartridge 227 to the apparatus body. In FIG. 21, the reference numeral 346 denotes a wiring resistance pattern provided on the upper surface of the ink cartridge 227, and the control unit of the apparatus body can detect the presence or absence of the mounted ink cartridge in accordance with conduction/non-conduction between the terminals 306A–306B depending on whether or not they are connected through contact with the contact portions of the wiring resistance pattern 346. Also, since this wiring resistance pattern is made into a resistance pattern having a resistance value determined in conformity with the color or density or the like of the ink containing this pattern, the control unit of the apparatus body can read the information thereof.

In the present embodiment, the location and dimensions of each coupling portion are determined so that three positions are defined in the direction of insertion: an inserted position 2201 in which the needle 314 penetrates through the plug 342 with the insertion of the ink cartridge 227 and the aperture 316 comes to the interior of the ink bag 340, whereby ink communication is accomplished; a position 2202 in which the terminals 306A and 306B are connected to the wiring resistance pattern 346; and a position 2203 in which the clips 320 are engaged with recesses 332, whereby the ink cartridge 227 is held. Under this arrangement, when the operator inserts the cartridge 227, the needle 314 first enters the interior of the ink bag 340, and when the cartridge is further inserted, the terminals 306A and 306B are then connected to the resistance pattern 346. Only when the cartridge is still further inserted do the clips 320 come into engagement with the recesses 332. In the case of the present embodiment, the ink cartridge 227 contains the waste ink also therein and therefore, it is desirable that in the position 2201, the waste ink pipe 318 be also positioned in the ink cartridge 227.

Figure 22:
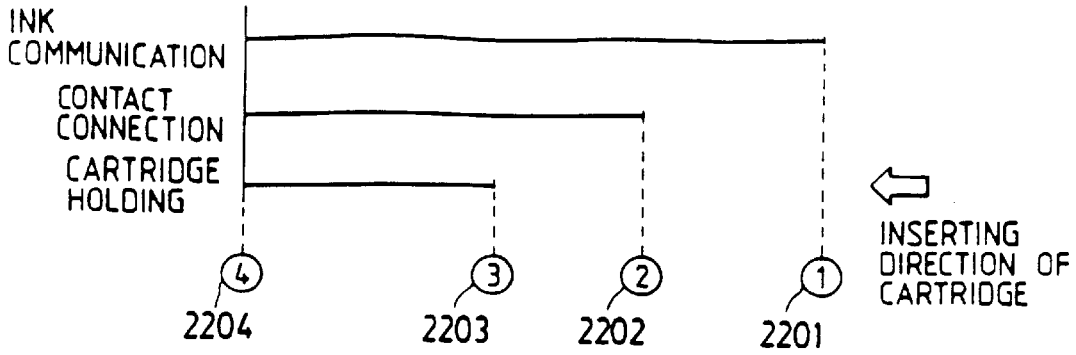
FIG. 22 illustrates the relation of the coupling positions in the present embodiment relative to the insertion of the ink cartridge.

The above-described positional relation is shown in FIG. 22. In FIG. 22, 2204 indicates a position in which the ink cartridge 227 finally strikes in the direction of insertion. The range from 2203 to 2204 is a range in which the cartridge 227 is movable in its held position due to the backlash of the clips 320 and recesses 332; that is, a range in which the clips 320 come into engagement with the recesses 332 and the cartridge 227 is further inserted until it strikes against the innermost part of the inserting portion 302.

If the above-described positions are not so arranged, there will occur inconveniences as shown in FIG. 23. In the arrangement shown in FIG. 23A, even if cartridge holding is done, the information regarding the cartridge cannot be read through the terminals 306A and 306B and therefore, in some cases, the control unit of the apparatus body may judge that the cartridge is not yet inserted. In the arrangement shown in FIG. 23B, contact connection is effected prior to ink communication and therefore, the control unit of the apparatus body may judge that the cartridge has been mounted, and may start a predetermined operation, whereby air may be introduced from the needle 314 into the ink supply system. This also holds true of the arrangement shown in FIG. 23C and moreover, if the operator discontinues the inserting operation as soon as a click sound is heard (indicating that the clips 320 have engaged the recesses 332), ink communication will not be provided at all.

Figure 23A:
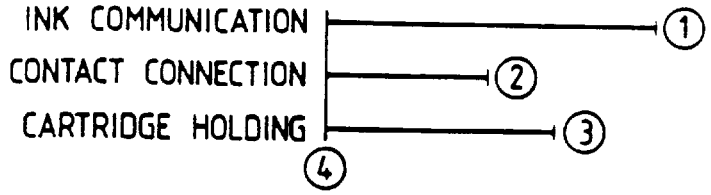
FIGS. 23A–23E illustrate inconveniences which occur when the coupling position relation as in the present embodiment is not adopted.
Figure 23B:
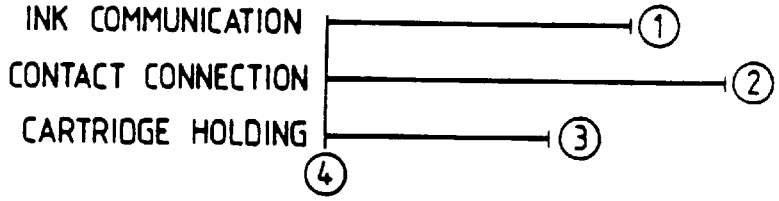
Figure 23C:
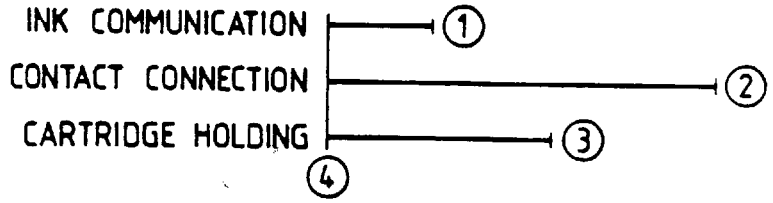
Figure 23D:
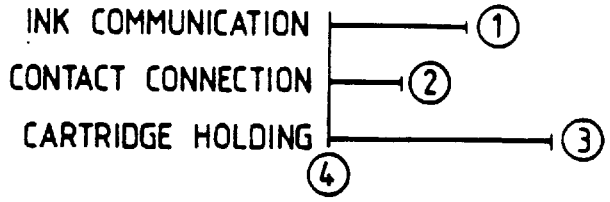
Figure 23E:
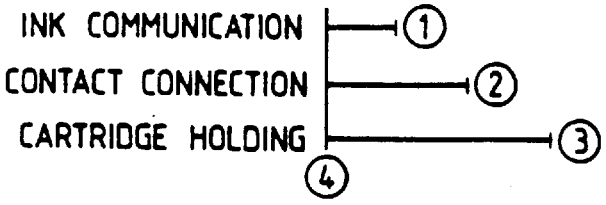

Also, in the arrangements shown in FIGS. 23D and 23E, in spite of cartridge holding being done, the needle 314 may not penetrate the plug 342, or contact connection may become unstable.

In contrast, according to the arrangement shown in FIG. 22, ink communication, contact connection and cartridge holding take place in the named order during the insertion of the cartridge and therefore, the operator only need confirm cartridge holding simply by a click sound or the like. Also, even if the control unit of the apparatus body immediately starts its operation in response to contact connection, there will not occur the inconvenience that air is introduced into the ink supply system. Conversely, even if the cartridge 227 is pulled out during the operation of the control unit of the apparatus body, the control unit of the apparatus body will detect this before ink communication is cut off; a similar inconvenience thus will not occur if the operation is discontinued.

Figure 24A:
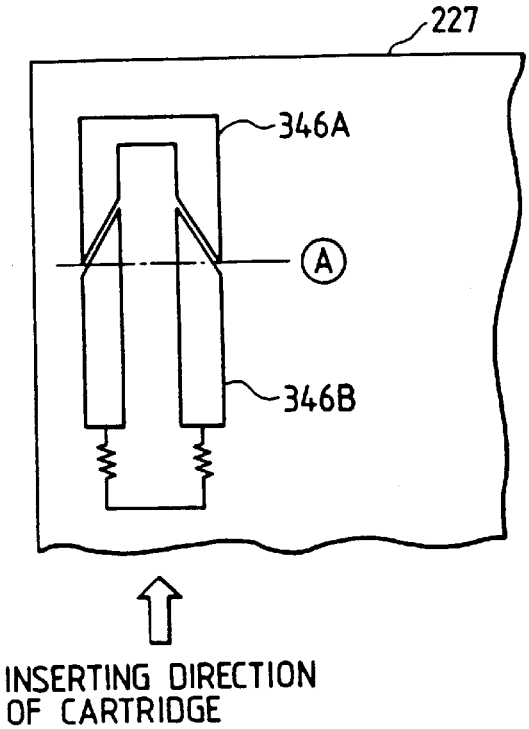
FIGS. 24A and 24B are a fragmentary enlarged view and a coupling position relation illustration, respectively, showing an improved embodiment of the ink cartridge of FIGS. 21 and 22.

FIG. 24A shows a further improvement in the above-described construction. In the example shown therein, the wiring resistance pattern is divided into two. The pattern lying forwardly with respect to the direction of insertion of the cartridge is a pattern 346A for short-circuiting the terminals 306A–306B, and the pattern lying rearwardly is a resistance pattern 346B having a resistance value determined in conformity with the color, density, etc. of the ink.

Figure 24B:
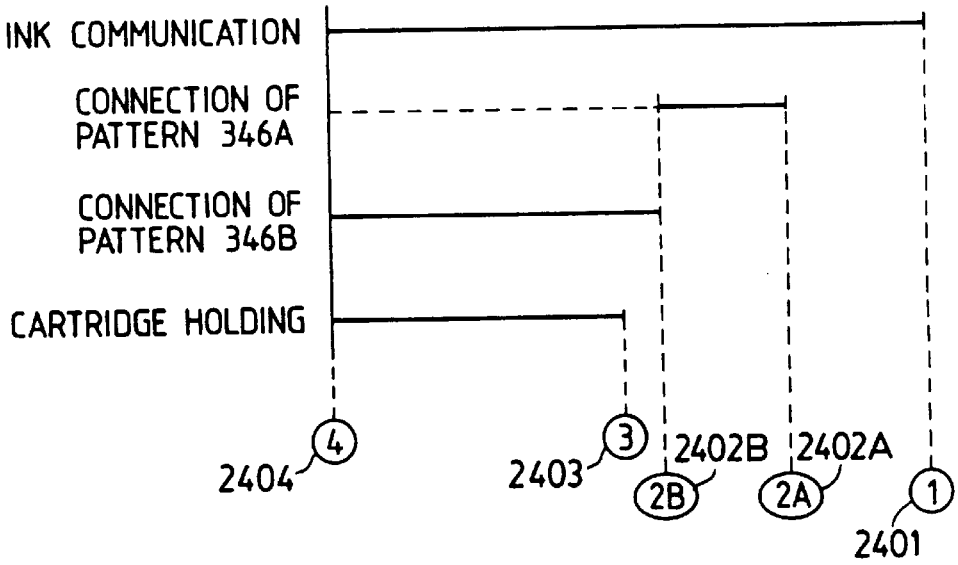

FIG. 24B shows the relation among a range within which ink communication is done in such a construction, a range within which the terminals 306A and 306B are in contact with the pattern 346A, a range within which the terminals 306A and 306B are in contact only with the pattern 346B, and a range within which the cartridge is held.

In FIG. 24B, 2401 indicates a limit position in which ink communication is done as described above, 2403 indicates a limit position in which the cartridge 227 is held, and 2404 indicates the innermost position in which the cartridge 227 strikes. Also, 2402A indicates a limit position with respect to the direction of insertion in which the terminals 306A and 306B are in contact with the pattern 346A and are short-circuited, and 2402B indicates a limit position with respect to the direction of insertion in which the terminals 306A and 306B are off the pattern 346A and in contact only with the pattern 346B and the resistance value of this pattern is read. Here, it is desirable that the position 2402B be at or near the position 2403; in the present example, this position is near the position 2403 in the direction of insertion of the cartridge, where the engagement between the clips 320 and the recesses 332 is released and the cartridge 227 is ready to slip out.

The relation among the various positions is as shown, and an effect similar to that of FIG. 21 is obtained. In the present embodiment, however, a still better effect is obtained by performing the following operation.

Figure 25A:
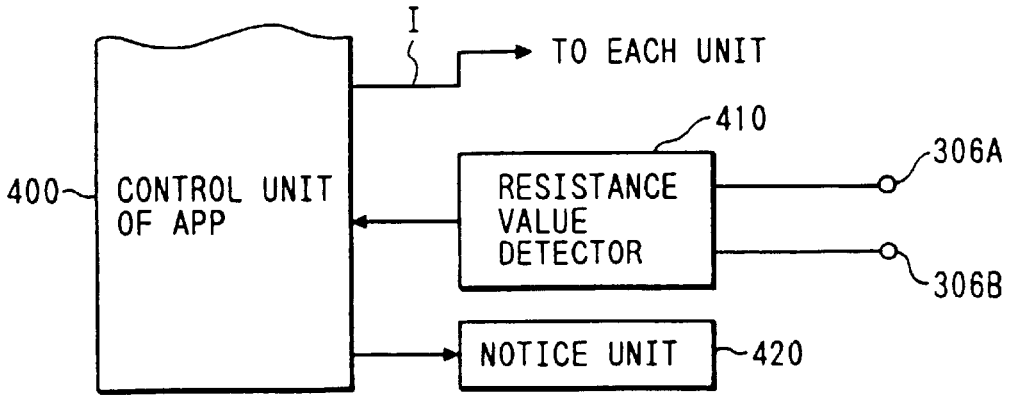
FIGS. 25A and 25B are block diagrams showing a control system for the construction shown in FIG. 24 and a flow chart showing an example of the operation thereof, respectively.

FIG. 25A diagrammatically shows the essential portions of a control circuit according to the present embodiment. In FIG. 25A, the reference numeral 400 designates the control unit of the apparatus body which may be in the form of a microcomputer having a CPU for effecting the process of FIG. 25B and other control of the entire apparatus, a ROM storing therein a program or the like corresponding to the process procedure, and a RAM for working. The reference numeral 410 denotes a detector for detecting the resistance value between the terminals 306A and 306B. When this resistance value is "0", the detector 410 indicates that the contacts are short-circuited by the pattern 346A; when the resistance value is infinity, it indicates that the ink cartridge 227 is not yet mounted; when the resistance value is a predetermined value, it indicates that the ink cartridge 227 is properly held. The reference numeral 420 designates a display device for a message or the like, or output means using sound or the like, or a notice unit which may comprise a combination thereof. The letter I denotes an operation stopping signal for each portion.

Figure 25B:
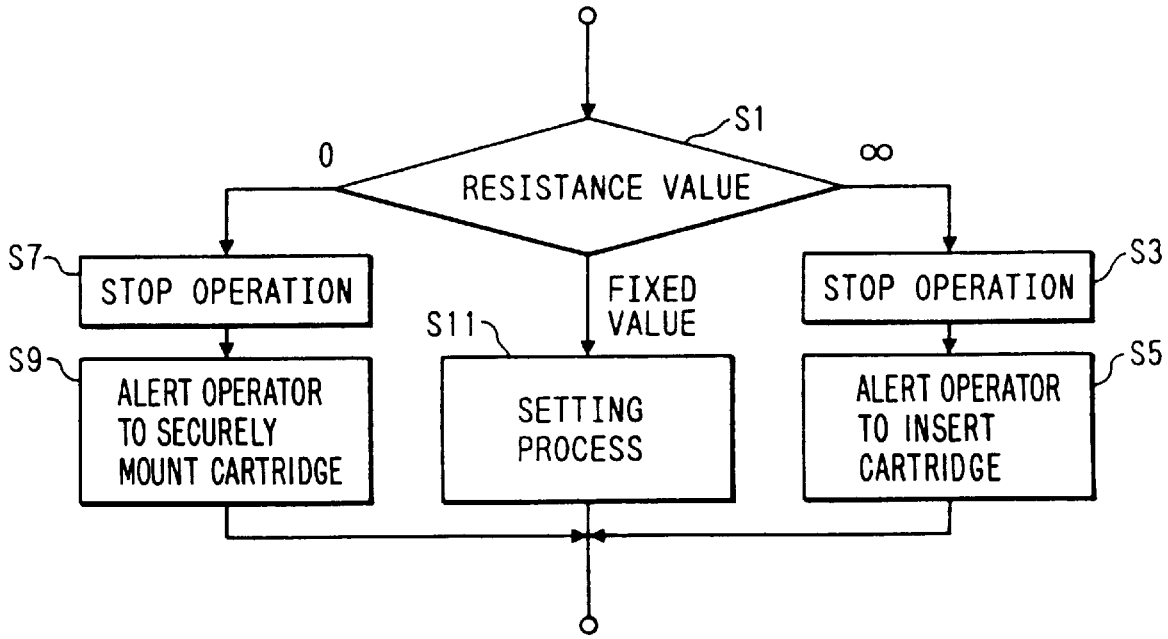

FIG. 25B shows an example of the operation procedure of the present embodiment. This procedure may be started at a suitable time during the closing of the power source switch of the apparatus or during the interchange of the ink cartridge 227, and in addition, during the recording operation.

When this procedure is started, the resistance value is first read at a step S1. If the resistance value is infinity, it means that the cartridge 227 is not mounted and therefore, advance is made to a step S3, where the operation of each portion is maintained in its stopped state, and at a step S5, the operator is alerted to insert the cartridge 227.

On the other hand, if the resistance value is "0", it means that the cartridge 227 is ready to slip out and therefore, advance is made to a step S7, where the operation of each portion is stopped. Then, at a step S9, the operator is alerted to make sure that the cartridge 227 is securely held.

Further, if the resistance value is a predetermined value, it means that the cartridge 227 is already securely held and therefore, the information (the color or the like of the ink) regarding the cartridge corresponding to that resistance value is recognized and a setting process corresponding thereto is carried out (step S11).

That is, when the operator has inserted the cartridge 227 but the clips 320 have not come into the recesses 332, or when the engagement therebetween has been released for some reason, the cartridge holding is not complete and therefore the cartridge is liable to slip out. In such a case, the terminals 306A and 306B are connected to the pattern 346A, so that the control unit 400 of the apparatus body becomes unable to read the inherent information of the cartridge 227. The control unit 400 of the apparatus body can therefore recognize such a situation and switch off the operation of the apparatus, thereby alerting the operator to securely insert the cartridge 227. Thus, the operator can be advised of the danger that the cartridge 227 will slip out of the apparatus.

If the positional relation as described above can be basically kept with regard to the reading position for the information regarding the supplied ink communication and the cartridge and the cartridge holding position, it is of course possible that the cartridge and the inserting portion therefor may be constructed in other suitable ways. For example, the cartridge holding need not utilize the clips and recesses. Further, the reading of the information regarding the ink cartridge need not always be electrical, but may be, for example, optical. Furthermore, in the above-described embodiment, the waste ink is also introduced into the cartridge, but the cartridge may also be of the type which effects ink supply alone.

By adopting such a construction, reliable reading of the information can be accomplished in the cartridge carrying thereon the information medium as previously described, and the driving of the recording head best suited for the ink used can be accomplished.

Embodiment 8

Figure 26:
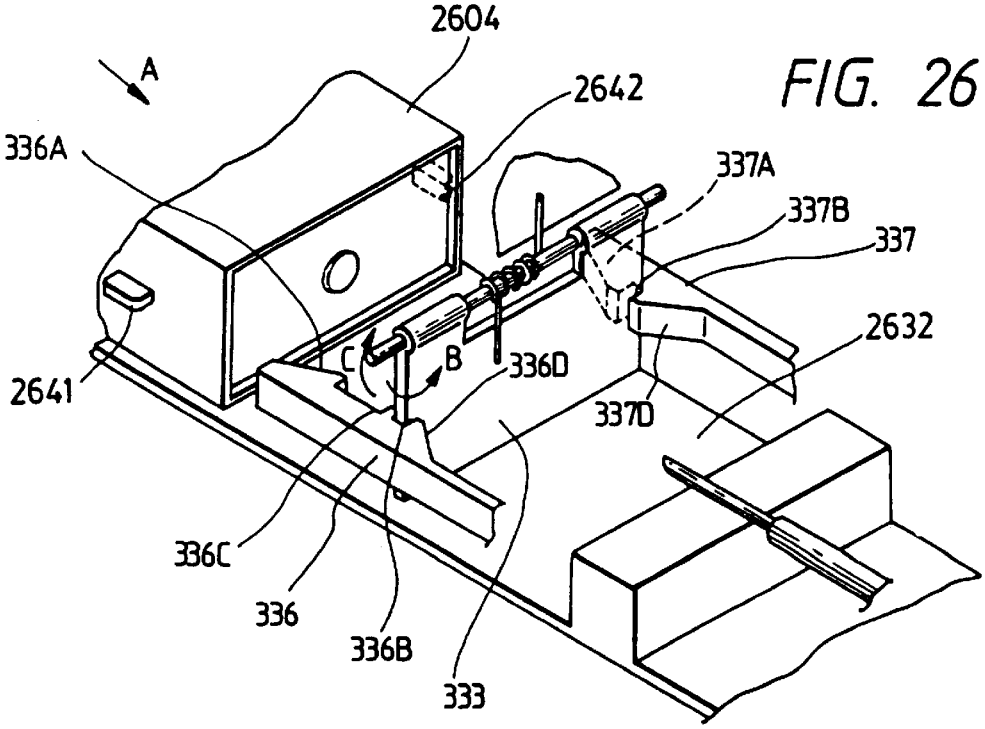
FIG. 26 is a perspective view showing an example of the construction of an ink cartridge mounting mechanism according to the present invention.

FIG. 26 shows another example of the ink cartridge mounting mechanism according to the present invention. In FIG. 26, the reference numeral 2604 designates an example of the ink cartridge according to the present invention, and the reference numerals 2641 and 2642 respectively denote unlocking members projectedly provided on the left and right side walls of the ink cartridge 2604. The reference numerals 336 and 337 designate locking members according to the present invention which are provided along the left and right sides, respectively, of an insertion path 2632. In the present embodiment, the left and right locking members 336 and 337 differ in shape from each other, as shown.

In the case of the present embodiment, the unlocking members 2641 and 2642 and the locking members 336 and 337 are all disposed at the same level above the bottom surface of the insertion path 2632, but the unlocking members 2641 and 2642 differ in their projected position in the direction of insertion. In this case, to prevent errors in manufacturing and malfunctioning of the apparatus, it is desirable that the amount of deviation between the unlocking members be 5 mm or more.

Thus, when the ink cartridge 2604 is further inserted from the state shown in FIG. 26 in the direction of arrow A, the locking member 2642 may reach the end of the wedge portion 337A of the locking member 337 in a state in which the unlocking member 2641 has reached the end of the wedge portion 336A of the locking member 336. The reference characters 336B and 337B designate locking grooves in the respective locking members, the reference character 336C denotes an escape portion, and the reference characters 336D and 337D designate returning wedge portions provided to return a protective plate 333 smoothly from its pushed-up position to its locked position as shown.

Figure 27A:
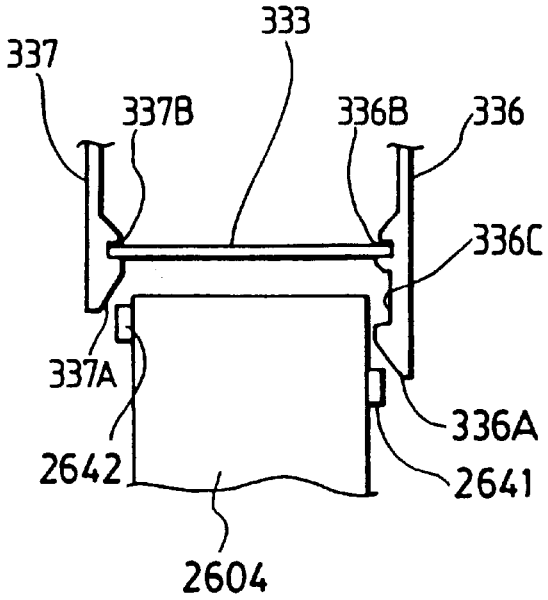
FIGS. 27A and 27B illustrate the normal cartridge mounting operation using the embodiment of FIG. 26.
Figure 27B:
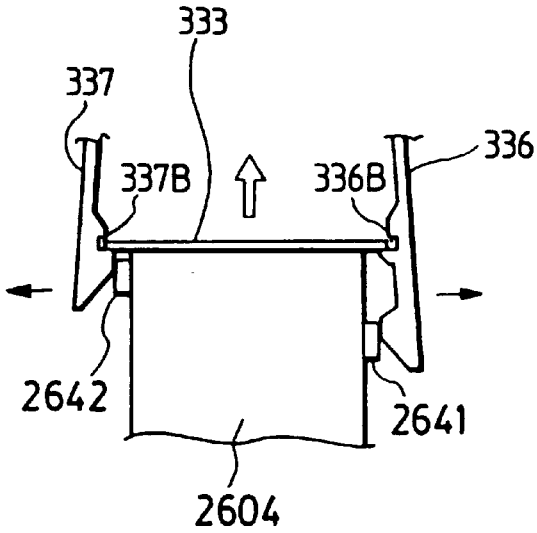
Figure 27C:
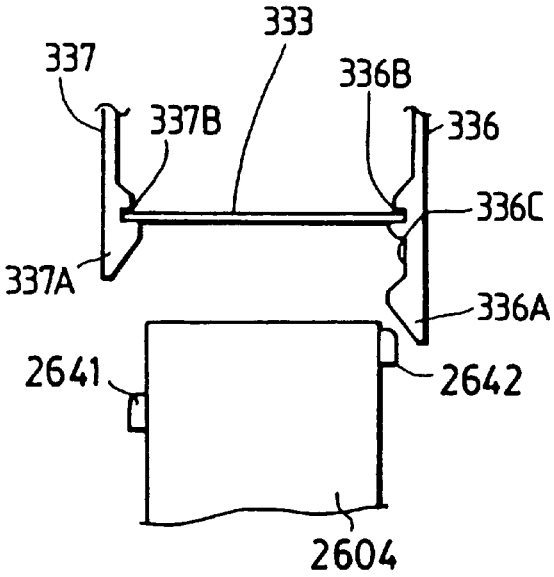
FIGS. 27C and 27D illustrate an incorrect mounting operation.

Reference is now had to FIGS. 27A–27D to describe the cartridge mounting operation in the ink cartridge mounting mechanism constructed as described above. First, when the ink cartridge 2604 is mounted in a normal posture, as shown in FIG. 27A, the unlocking members 2641 and 2642 provided on both sides of the ink cartridge 2604 slidably contact with the wedge portion 336A of the locking member 336 and the wedge portion 337A of the locking member 337, respectively, and pivotally move the locking members 336 and 337 in opposite directions as shown in FIG. 27B, thereby liberating the protective plate 333 from the restraint of the locking grooves 336B and 337B, and rotate the protective plate 333 in the direction of arrow B against the spring force of a spring 335 as shown in FIG. 26. The ink cartridge 2604 can thus be directed to its mounted position.

Figure 27D:
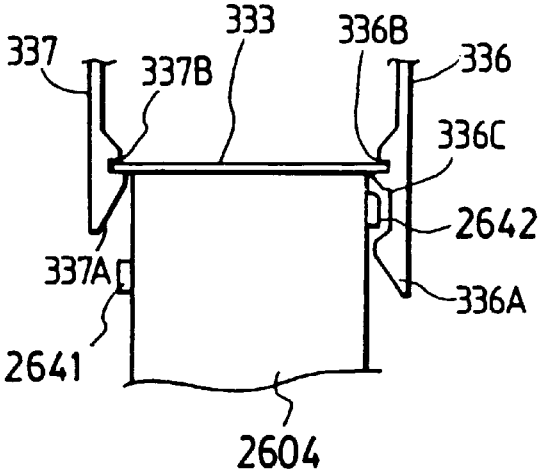

However, when the ink cartridge 2604 is mounted upside down by mistake (as shown, for example, in FIG. 27C), the unlocking members 2461 and 2642 and the locking members 336 and 337 do not both pivotally move, as shown in FIG. 27D; thus the protective plate 333 is not liberated from these locking members. Also, even if the locking members 336 pivotally move at all, the unlocking member 2642 will be stopped in the escape portion 336C and the front face of the ink cartridge will bear against the protective plate 333. Consequently, the inserting movement of the ink cartridge 2604 will be prevented by the protective plate 333 and the ink cartridge 2604 will not be directed to its mounted position. When the ink cartridge 304 is about to be mounted with its front and rear reversed (a situation not shown in the Figures), the unlocking members are likewise absent and therefore the locking members 336 and 337 are not operated. The reliability of the cartridge mounting is thereby ensured and thus, the transmission of the information from the information medium carried on the cartridge can also be reliably accomplished.

Embodiment 9

FIG. 28 shows still another embodiment of the present invention. In the ink cartridge 2804 according to this embodiment, the unlocking members 2841 and 2842 provided on both sides thereof are made to differ from each other in height relative to the insertion path 2832. Again in the present embodiment, it is desirable for the same reason as set forth in the previous embodiment that the amount of the deviation between the unlocking members be 5 mm or more. Thus, the locking members 336 and 337 are also disposed with heights corresponding to the unlocking members 2841 and 2842.

In the ink cartridge mounting mechanism constructed as described above, even if the ink cartridge 2804 is inserted upside down, the left and right unlocking members 2841 and 2842 will not come into engagement with the locking members 336 and 337, and if the ink cartridge is inserted with its front and rear reversed, the unlocking members are not present on the first half of the cartridge, so that the locked state of the protective plate 333 is not released; incorrect mounting of the cartridge is thus prevented.

FIGS. 29A and 29B show an ink cartridge according to yet still another embodiment of the present invention. The present embodiment is such that the locations of the unlocking members are changed for each ink cartridge; for example, ink cartridges containing therein inks which differ in the characteristics thereof, such as color, etc., can be correctly mounted on their corresponding mounting portions. That is, the ink cartridge 304A shown in FIG. 29A and the ink cartridge 304B shown in FIG. 29B are made to differ in the locations of unlocking members 3341 and 3342 in the direction of height, and the amounts of horizontal deviation thereof differ from each other as indicated by D1 and D2.

Assuming, for example, that red ink is contained in the ink cartridge 304A and black ink is contained in the ink cartridge 304B, locking members (not shown) provided on the mounting portion of a red ink supply system and the mounting portion of a black ink supply system would then be made to correspond to the heights of the unlocking members 3341 and 3342, so that, even if an attempt is made to mount an ink cartridge of an incorrect, different color, the mounting thereof can be prevented. At the same time, the mounting of the individual ink cartridges 304A and 304B themselves in a wrong posture can be prevented. Since incorrect mounting is thus prevented, the reliable transmission of information can be accomplished in the cartridges of the above-described construction, each having an appropriate information medium. optimum driving of the recording head matching the ink used thus can be accomplished.

Embodiment 10

Figure 30A:
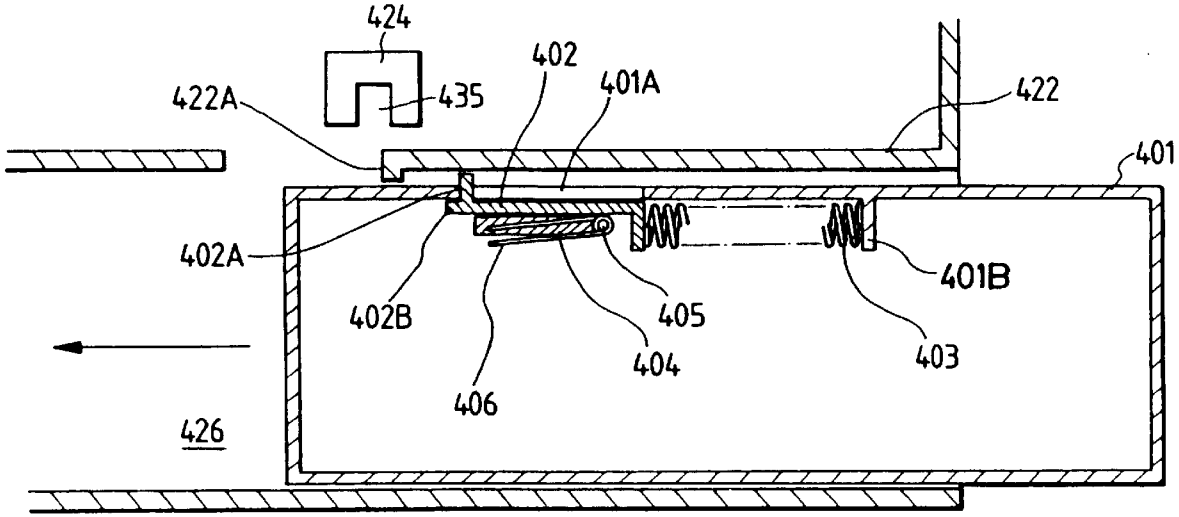
FIGS. 30A and 30B respectively illustrate the construction of the ink cartridge according to the present invention before and after the cartridge is mounted.
Figure 30B:
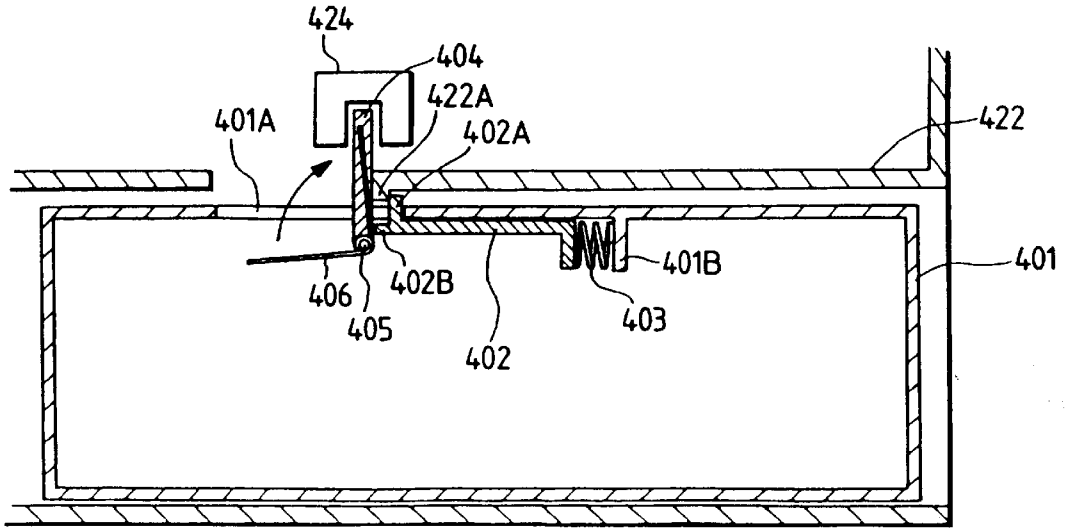

FIGS. 30A and 30B show another embodiment of the ink cartridge according to the present invention. In these figures, the reference numeral 401 designates an ink cartridge having therein an ink containing portion (not shown), the reference numeral 402 denotes a shutter which is slidable along an opening 401A in the upper surface of the cartridge 401, the reference character 402A designates a shutter projection projected upwardly from the shutter 402, and the reference numeral 403 denotes a coil spring interposed between the shutter 402 and a spring receiving wall 401B. By this coil spring 403, the shutter 402 is biased leftward along the opening 401A and the shutter projection 402A is caused to bear against the end edge of the opening 401A to thereby keep the opening 401A closed.

The reference numeral 404 designates a flag member pivotable about a support shaft 405 and formed, for example, of a material capable of intercepting infrared light. The support shaft 405 is journalled to the wall portion of the cartridge 401. The reference numeral 406 denotes a torsion coil spring provided around the support shaft 405 and having one end thereof restrained by the flag member 404 and the other end secured to the wall portion of the cartridge 401. The torsion coil spring 406 biases the flag member 404 clockwise about the shaft 405 to thereby bias the same toward the back side of the shutter 402. On the other hand, the reference character 422A designates a stopper portion projecting from a cartridge guide 422 toward a cartridge insertion path 426. When the ink cartridge 401 is inserted from right to left as viewed in FIG. 30A, the shutter projection 402A bears against the stopper portion 422A, and with a further inserting operation thereafter, it serves to open the shutter 402 against the spring force of the spring 403.

The reference numeral 424 denotes a light detecting sensor of the transmission type having, for example, an infrared light detecting function. The sensor 424 is carried on a carriage. When the ink cartridge 401 is inserted from the state of FIG. 30A along the cartridge insertion path 426, the shutter 402 is opened by the stopper portion 422A as previously described. In the completely mounted state of the ink cartridge 401 shown in FIG. 30B, the shutter 402 is fully opened and at the same time, the flag member 404 is cocked up by the spring force of the torsion coil spring 406, bears against the stopper portion 422A, and is kept in a posture for intercepting the optical path of the detecting sensor 424. The end portion 402B of the shutter 402 which projects along the direction of the opening 401A serves to suppress the cocking-up of the flag member 404 when the ink cartridge 401 does not assume the completely mounted position shown in FIG. 30B. If the cartridge assumes an incompletely mounted position, the flag member 404 is not cocked up, and complete mounting of the cartridge is not detected by the detecting sensor 424; the incomplete insertion of the ink cartridge 401 can thus be prevented. Accordingly, in this case, it is preferable to keep the gap between the flag member 404 and the shutter 402 as small as possible. By doing so, the timing at which the flag member 404 is cocked up, i.e., the timing at which the ink cartridge 401 is completely mounted, can be made more accurate.

Also, when the ink cartridge 401 is to be removed from the recording apparatus, the ink cartridge 401 is drawn out rightward from the state of FIG. 30B, so that the flag member 404 is pushed by the stopper portion 402A and is rotated counterclockwise; the shutter 402 also is moved by the spring force of the coil spring 403 in a direction to close the opening 401A. In the completely demounted state of the cartridge, the flag member 404 is housed under the shutter 402.

In the ink cartridge thus constructed, the flag member for detecting the mounting of the cartridge, which is provided in the cartridge itself, is housed in the interior thereof before the cartridge is mounted and thus, does not spoil the external appearance of the cartridge. The cartridge is also made easy to handle. On the other hand, in the recording apparatus body it is only required to dispose a hole for cocking up and down the flag member and a stopper portion provided in he cartridge guide. Moreover, as will be described later, by a simple construction, various kinds of information regarding the ink cartridge can be provided to the user with high reliability.

Such a construction enables the cartridge to be reliably mounted with respect to the apparatus and therefore, for example, in the case of a cartridge carrying an information medium thereon, the corresponding information is reliably transmitted.

Figure 31A:
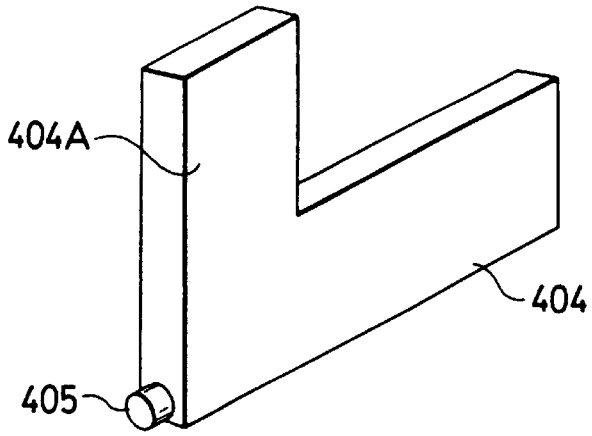
FIGS. 31A–31C are perspective views showing the three kinds of forms of the flag member in the ink cartridge according to the present invention.
Figure 31B:
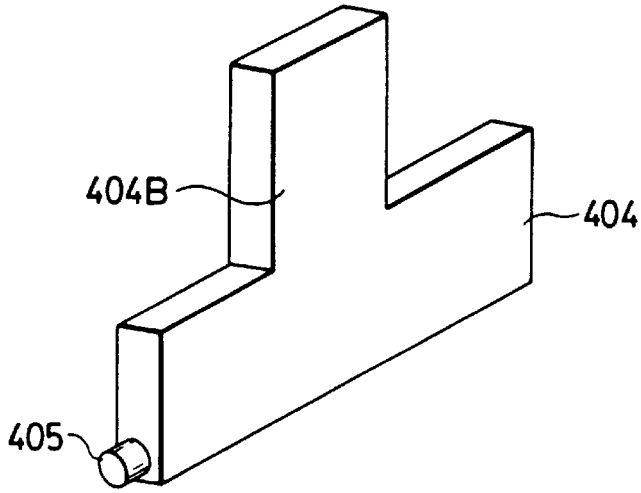
Figure 31C:
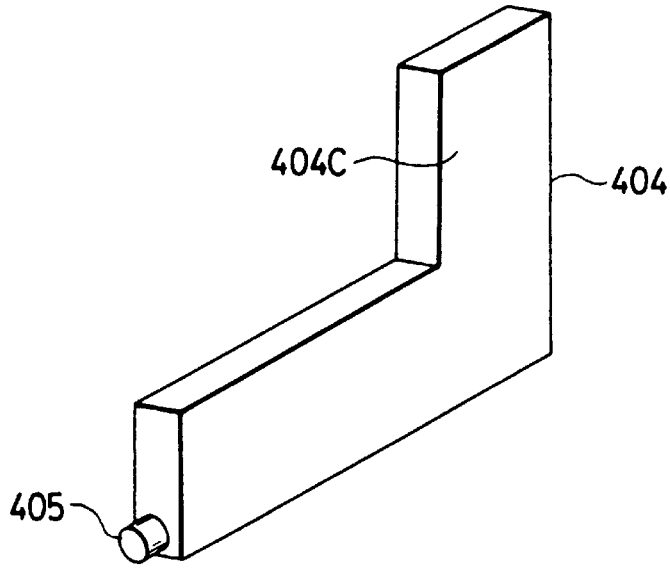

FIGS. 31A–31C show another embodiment of the ink cartridge according to the present invention. In these figures, only a flag member 404 is shown, and the reference characters 404A, 404B and 404C designate the light intercepting portions thereof. Since the light intercepting portions 404A, 404B and 404C differ in accordance with the direction along the support shaft 405 thereof, i.e., the direction of movement of the carriage, the detecting position of the detecting sensor shown in FIGS. 30A and 30B can be changed, so that different information regarding the ink cartridge 401 (in the case of the present embodiment, three kinds of information) can be obtained due to the difference in the detecting position. This is an example of another form of the aforedescribed information medium. Accordingly, the flag member 404, which differs in the position of the light intercepting portion as described above from cartridge to cartridge containing ink therein, may be used to show the kind, the characteristics or the like of the ink contained in the cartridge 401; the number of kinds of information is not limited to three as described above.

The amount of information which can be handled in this fashion differs depending on the resolving power during the carriage scanning and the detection width of the detecting sensor. If the detector is designed so that detection of a width of 20 mm is done, for example, by scanning for 2 mm each, a flag member in which the light intercepting portion is changed in position in increments of 2 mm may be provided in each cartridge; accordingly, ten kinds of information can be obtained. If an attempt is made to obtain such information by the conventional system, ten independent flags will be necessary. Moreover, such flags will have to be arranged at intervals of 2 mm on the recording apparatus side; this will unavoidably lead to an increased number of parts as well as complication, bulkiness and increased cost of the apparatus. By constructing the cartridge as shown in the present embodiment, it becomes possible to save space by using a minimum number of parts and still provide numerous kinds of information regarding the ink cartridge.

Figure 32A:
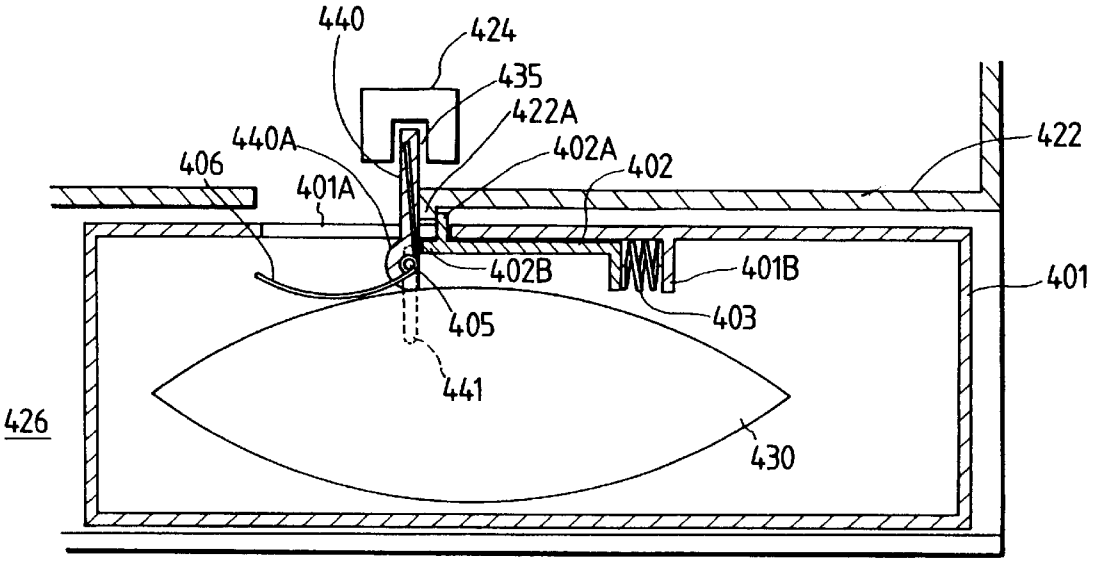
FIGS. 32A and 32B illustrate the operation of another embodiment of the ink cartridge according to the present invention in a state in which ink is present and a state in which ink is absent, respectively.
Figure 32B:
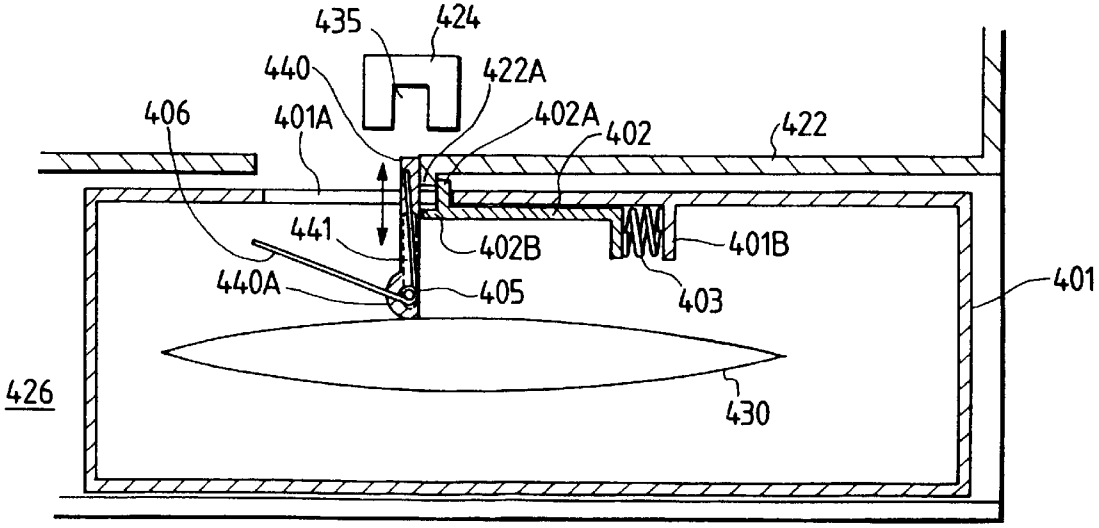

FIGS. 32A and 32B show still another embodiment of the present invention and an arrangement for transmitting information indicative of the presence or absence of ink. The present embodiment includes an ink bag 430 in the cartridge 401, and a flag member 440 for informing the user that the amount of ink remaining in the ink bag has become, for example, a predetermined amount or less. In the end portion of that side of the flag member 440 on which a support shaft 405 is provided, there is formed a contact portion 440A which protrudes substantially in the form of a semicircle. Such a contact portion 440A may always keep contact with the surface of the ink bag 430, both in the completely mounted state of the ink cartridge 401 as shown in FIGS. 32A and 32B and in the state of the ink cartridge before mounting (not shown).

The reference numeral 441 denotes longitudinal slots formed in two wall portions of the ink cartridge 401 which are parallel to the plane of the drawing sheet, and the support shaft 405 of the flag member 440 is fitted in these slots 441 and thereby supported for vertical movement and rotational movement. Also, in the case of the present embodiment, a torsion coil spring 406 mounted around the support shaft 405 has a spring force for biasing the flag member 440 clockwise and biasing the support shaft 405 downwardly along the slots 441, so that the contact portion 440A of the flag member 440 is biased toward the ink bag 430.

According to the ink cartridge 401 thus constructed, before the cartridge 401 is mounted at a predetermined mounting position along an insertion path 426, the flag member 440 is housed under the shutter 402 in the same manner as described previously in connection with FIG.

30A. However, when the cartridge is securely mounted at the predetermined mounting position, the flag member 440 rises in the manner shown in FIG. 32A or 32B. Thus, simultaneously with the rising of the flag member, the contact portion 440A of the flag member 440 is biased toward the surface of the ink bag 430 by the spring force of the torsion coil spring 406.

In the ink cartridge 401 thus provided with the ink bag 430 as an ink containing means, when ink is sufficiently stocked in the ink bag 430 the entire flag member 440 rises to a high position as shown in FIG. 32A. The light intercepting portion of the flag member is thus kept at a height for intercepting the optical path 435 of a detecting sensor 424, and when the carriage is directed to the position of the cartridge 401, the presence of ink is detected by the detecting sensor 424 carried on the carriage. Also, when the ink becomes exhausted, the flag member 440 rises only to a low position as shown in FIG. 32B, so that the flag member 440 does not intercept the optical path 435 of the detecting sensor 424, and the ink is judged to be absent.

As is apparent from the foregoing description, according to the present invention, a medium including the information for driving the ink jet head is provided on the ink cartridge, whereby the ink jet recording apparatus itself can automatically set the driving conditions of the ink jet head matching the composition of ink and therefore, there can be provided an ink jet recording apparatus which is simple to operate and high in reliability.

Also, there can be provided an ink cartridge which can be prevented from being erroneously inserted by the user and which has information for properly controlling the driving of the recording head.

Also, as described above, according to the present invention, in the position wherein an ink tank in the form of a cartridge forming an ink supply source is mounted in the apparatus body, the ink communication with the ink supply system is done prior thereto, and the ink communication state therefore can be secured near the position at which the ink tank is mounted. Also, the information regarding the ink tank is readable prior to the mounting of the ink tank, so that misjudgments or difficulties in reading do not occur near the mounting position. Further, the ink communication is done prior to reading and therefore, even if the recording operation is immediately started in response to reading, there will not occur the inconvenience of air being introduced into the ink supply system. Conversely, if the ink tank is pulled out during the recording operation, this can be detected before the ink communication is cut off and therefore, no similar inconvenience will occur if the operation is discontinued.

Further, as described above, according to the present invention, in the position wherein an ink tank in the form of a cartridge forming an ink supply source is mounted in the apparatus body, the ink communication with the ink supply system is done prior thereto and therefore, the ink communication state can be secured near the mounting position of the ink tank. Also, the inherent information regarding the ink tank becomes readable near the mounting position, and the information differing from said information is read in a predetermined range from the ink communication position to the vicinity of the mounting position. Therefore, if the apparatus is designed so that a warning is given in response to the reading of the information, an unsatisfactory mounting of the ink tank can be detected to obviate the slipping out thereof.

Furthermore, as has been described above, according to the present invention, unlocking members projecting from opposite sides of the ink cartridge and locking members provided on both sides of the insertion path for the ink cartridge and unlockable by the respective unlocking members are provided asymmetrically with respect to the direction of insertion of the ink cartridge. Therefore, even if an attempt is made to insert the ink cartridge with its vertical direction or its longitudinal direction being mistaken, the ink cartridge can be prevented from being erroneously mounted. Accordingly, damage to the ink cartridge by the hollow needle, or damage to the hollow needle which would make the supply of ink impossible, can be eliminated.

Further, a special or expensive device is not required for the prevention of such erroneous mounting; it is only required to simply change the installed positions of the locking members and the unlocking members. Furthermore, even where a plurality of kinds of inks are used, erroneous mounting can be prevented for the respective ink cartridges.

Also, as has already been described, according to the ink jet recording apparatus of the present invention and the ink cartridge therefor, a transmission type photosensor shielded from light by a flag member located in the movement path of the carriage is provided on the carriage, and a flag member which protrudes toward the movement path of the carriage only in the mounted state of the ink cartridge is provided on the ink cartridge. The transmission type photosensor is shielded from light by the flag member provided on the ink cartridge, so that the mounting of the ink cartridge may be detected. Therefore, not only is the mounting of the ink cartridge detected by a small number of parts and simple structure, but also (since the form of the flag member is made different for each ink cartridge) many kinds of information such as the kind, characteristic, etc. of ink can be recognized by the user; in addition, the quantity of remaining ink can be detected.

The present invention is particularly effective in a recording head and a recording apparatus of the bubble jet type which has been put forward by Canon, Inc., among the ink jet recording systems.

As regards the typical construction and principle of this system, a construction is preferable which uses the basic principle disclosed, for example, in U.S. Pat. Nos. 4,723,129 and 4,740,796. This system is applicable to both the so-called on-demand type and the so-called continuous type. In the case of the on-demand type, the present invention is particularly effective because at least one driving signal corresponding to recording information and providing a rapid temperature rise exceeding nucleate boiling is applied to an electro-thermal converting member disposed correspondingly to a sheet or a liquid path in which liquid (ink) is retained, thereby causing the electro-thermal converting member to generate heat energy and causing film boiling on the heat-acting surface of a recording head with a result that a bubble in the liquid (ink) can be formed correspondingly to the driving signal. Due to the growth and contraction of the bubble, the liquid (ink) is discharged through a discharge port to thereby form at least one droplet. If this driving signal is made into a pulse shape, the growth and contraction of the bubble take place appropriately on the spot and therefore, discharge of the liquid (ink) with particularly high responsiveness can be accomplished, which is highly preferable. The driving signal of such a pulse shape may suitably be one as described in U.S. Pat. Nos. 4,463,359 and 4,345,262. The adoption of the conditions described in U.S. Pat. No. 4,313,124, which is an invention relating to the temperature rise rate of said heat-acting surface, would lead to the possibility of accomplishing still better recording.

As regards the construction of the recording head, besides the construction as disclosed in the aforementioned patents which comprises a combination of discharge ports, liquid paths and electro-thermal converting members (a straight liquid flow path or a perpendicular liquid flow path), the constructions using U.S. Pat. Nos. 4,558,333 and 4,459,600, which disclose constructions in which the heat-acting portion is disposed in a bent area, are also covered by the present invention. In addition, the present invention is effective for use with a construction based on Japanese Laid-Open Patent Application No. 59-123670, which discloses a construction in which a slit common to a plurality of electrothermal converting members is the discharge portion of the electrothermal converting members, or with a construction based on Japanese Laid-Open Patent Application No. 59-138461, which discloses a construction in which an opening for absorbing a pressure wave of heat energy corresponds to the discharge portion.

Further, a recording head of the full line type having a length corresponding to the width of the largest recording medium on which the recording apparatus can effect recording may be of a construction as disclosed in the above-mentioned publications, wherein that length is made up of a combination of a plurality of recording heads, or of a construction as a single recording head formed as a unit; the present invention is also effective with such a recording head.

In addition, the present invention is effective in a case where use is made of a recording head of the interchangeable chip type which is mounted on an apparatus body to thereby provide the electrical connection to the apparatus body or the supply of ink from the apparatus body, or a recording head of the cartridge type provided integrally on the recording head itself.

Also, the addition of recovery means, preliminary auxiliary means, etc. for the recording head provided in the construction of the recording apparatus usable with the present invention can further stabilize the effect of the present invention and is therefore preferable. Specifically, these means include capping means, cleaning means and pressurizing or suction means for the recording head, an electro-thermal converting member or a heating element discrete therefrom, or pre-heating means comprising a combination of these, all of which are effective for accomplishing stable recording to carry out the preliminary discharge mode in which a discharge not concerned with recording is effected.

Further, the recording mode of the recording apparatus is not limited to a recording mode using only the main color such as black, but may use a recording head constructed as a unit or a combination of a plurality of recording heads, and the present invention is very effective for an apparatus provided with a plurality of different colors or at least one of full colors provided by mixed colors.

The above embodiments of the present invention have been described as using liquid ink, but the present invention also permits the use of ink which is in the solid phase at room temperature or ink which becomes softened at room temperature. In the above-described ink jet recording apparatus, it is popular to regulate the temperature of ink within a range from 30° C. to 70° C. and to effect temperature control so that the viscosity of the ink may be within a stable discharge range; use therefore can be made of ink which assumes the liquid phase when the recording signal is imparted. In addition, the temperature rise due to heat energy is positively used as the energy to change the ink from its solid phase to its liquid phase to thereby prevent said temperature rise. The use of this type of ink, or ink which solidifies when left as it is used for the purpose of preventing the evaporation of the ink, or the use of some other ink that is liquefied only by heat energy (such as ink which is liquefied by the imparting of heat energy conforming to the recording signal and is discharged in the form of liquid or ink which already begins to solidify at a point of time at which it reaches the recording medium) is also applicable with the present invention. In such a case, the ink may assume the form as described in Japanese Laid-Open Patent Application No. 54-56847 or Japanese Laid-Open Patent Application No. 60-71260, wherein the ink is retained as liquid or solid in recesses or through-holes in a porous sheet and is opposed to an electro-thermal converting member. In the present invention, what is most effective for each ink mentioned above is what executes the above-described film boiling system.

What is claimed is:

1. An ink cartridge removably mountable on a fixed mounting portion of an ink jet recording apparatus, said ink cartridge supplying ink to a recording head for discharging the ink, the recording head being carried on a movable carriage of said apparatus, said ink cartridge comprising:

a flag member mounted for protrusion and retraction; and an opening-closing member for opening and closing according to mounting of said ink cartridge on and dismounting of said ink cartridge from said ink jet recording apparatus, wherein in a state that said ink cartridge is not mounted on the ink jet recording apparatus, said opening-closing member is in a closed state to keep said flag member retracted in said ink cartridge, and in a state that said ink cartridge is mounted on the ink jet recording apparatus, said opening-closing member is in an open state to allow said flag member to project outside of said ink cartridge.

2. An ink cartridge according to claim 1, wherein said flag member is capable of following a change caused upon an ink consumption inside an ink bag for containing the ink received in said ink cartridge.

3. An ink cartridge according to claim 1, wherein said flag member has a function to transmit the presence or absence of said ink cartridge to said recording apparatus.

* * * * *

UNITED STATES PATENT AND TRADEMARK OFFICE

CERTIFICATE OF CORRECTION

PATENT NO. : 6,062,667
DATED : May 16, 2000
INVENTOR(S) : Shinya Matsui et al.

It is certified that error appears in the above-identified patent and that said Letters Patent is hereby corrected as shown below:

Title page,
Item [75], please amend the list of inventors to include the following omitted inventors: -- Kenichiro Hashimoto and Takashi Nojima --.

Item [56], References Cited, FOREIGN PATENT DOCUMENTS, please delete the duplicate occurrence of the following references:
-- 1141750 6/1999 Japan --; and -- W086/6032 10/1986 WIPO --

Column 5,
Line 37, change “contact” to -- make contact --.

Column 6,
Line 45, delete “of”

Column 8,
Line 11, change “further” to -- a further --

Column 11,
Line 53, change “partly” to -- a partly --.

Column 13,
Line 33, change “the ink” to -- ink --.

Column 15,
Line 40, change “the ink” to -- ink --; and
Line 49, change “such” to -- such as --.

Column 19,
Line 28, change “pivotably” to -- pivotally --.

Column 25,
Line 46, change “members 2461” to -- members 2641 --.

UNITED STATES PATENT AND TRADEMARK OFFICE

CERTIFICATE OF CORRECTION

PATENT NO. : 6,062,667
DATED : May 16, 2000
INVENTOR(S) : Shinya Matsui et al.

It is certified that error appears in the above-identified patent and that said Letters Patent is hereby corrected as shown below:

Column 26,
Line 45, change “optimum" to -- Optimum --.

Column 27,
Line 55, change “he” to -- the --.

Signed and Sealed this

Nineteenth Day of November, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,062,667
DATED : May 16, 2000
INVENTOR(S) : Shinya Matsui et al.

It is certified that error appears in the above-identified patent and that said Letters Patent is hereby corrected as shown below:

Title page,
Item [75], Inventors, insert -- Kenichiro Hashimoto and Takashi Nojima --
Item [56], References Cited, FOREIGN PATENT DOCUMENTS, delete duplicate occurrence of "1141750 6/1999 Japan"; and "W086/6032 10/1986 WIPO".

Column 5,
Line 37, change "contact" to -- make contact --.

Column 6,
Line 45, delete "of".

Column 8,
Line 11, change "further" to -- a further --.

Column 11,
Line 53, change "partly" to -- a partly --.

Column 13,
Line 33, change "the ink" to -- ink --.

Column 15,
Line 40, change "the ink" to -- ink --; and
Line 49, change "such" to -- such as --.

Column 19,
Line 28, change "pivotably" to -- pivotally --.

Column 25,
Line 46, change "members 2461" to -- members 2641 --.

Column 26,
Line 45, change "optimum" to -- Optimum --.

UNITED STATES PATENT AND TRADEMARK OFFICE

CERTIFICATE OF CORRECTION

PATENT NO. : 6,062,667
DATED : May 16, 2000
INVENTOR(S) : Shinya Matsui et al.

It is certified that error appears in the above-identified patent and that said Letters Patent is hereby corrected as shown below:

Column 27,
Line 55, change “he” to -- the --.

Signed and Sealed this

Third Day of August, 2004

JON W. DUDAS
*Acting Director of the United States Patent and Trademark Office*